US006115571A

United States Patent [19]

Kobayashi

[11] Patent Number: 6,115,571

[45] **Date of Patent: *Sep. 5, 2000**

[54] TONER SUPPLY CONTAINER, PROCESS CARTRIDGE AND ELECTROPHOTOGRAPHIC IMAGE FORMING APPARATUS

[75] Inventor: Kazunori Kobayashi, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,563

[22] Filed: Apr. 30, 1997

Related U.S. Application Data

[63] Continuation of application No. 08/629,754, Apr. 9, 1996, abandoned.

[30] Foreign Application Priority Data

Apr. 17, 1995 [JP] Japan ..... 7-116531

[51] Int. Cl.[7] ..... G03G 15/08

[52] U.S. Cl. ..... 399/119; 399/111; 206/515

[58] Field of Search ..... 399/119, 120, 399/258, 259, 111; 222/DIG. 1; 206/508, 515, 519, 499

[56] References Cited

U.S. PATENT DOCUMENTS

| | | | |
|---|---|---|---|
| 4,607,939 | 8/1986 | Saito | 355/3 DD |
| 4,839,691 | 6/1989 | Tagawa et al. | 222/DIG. 1 |
| 4,949,123 | 8/1990 | Takashima | 355/260 |
| 5,034,776 | 7/1991 | Sugiura | 355/260 |
| 5,078,303 | 1/1992 | Kikuchi et al. | 222/DIG. 1 |
| 5,229,824 | 7/1993 | Tsusaka et al. | 355/260 |
| 5,289,243 | 2/1994 | Sakamoto | 355/260 |
| 5,331,372 | 7/1994 | Tsuda et al. | 355/200 |
| 5,404,198 | 4/1995 | Noda et al. | 355/200 |
| 5,455,665 | 10/1995 | Bada et al. | 355/298 |
| 5,470,635 | 11/1995 | Shirai et al. | 428/131 |
| 5,475,470 | 12/1995 | Sasago et al. | 355/210 |
| 5,475,478 | 12/1995 | Nishimura et al. . | |
| 5,510,878 | 4/1996 | Noda et al. | 355/211 |

FOREIGN PATENT DOCUMENTS

| | | | |
|---|---|---|---|
| 0470675 | 2/1992 | European Pat. Off. . | |
| 483440 | 5/1992 | European Pat. Off. | 355/260 |
| 0581199 | 2/1994 | European Pat. Off. . | |
| 62-129877 | 6/1987 | Japan . | |
| 2-186375 | 7/1990 | Japan . | |
| 3-107880 | 5/1991 | Japan | 355/260 |
| 7-325484 | 12/1995 | Japan . | |

*Primary Examiner*—Richard Moses

*Attorney, Agent, or Firm*—Fitzpatrick, Cella, Harper & Scinto

[57] ABSTRACT

A developer supply container for supplying a developer for developing a latent image formed on a photosensitive member is provided, wherein the container is inserted into a developer accommodating container which is provided in a process cartridge, through an entrance opening, and the developer is supplied while the container is in the developer accommodating container, and wherein the entrance opening is covered by an openable cover, and wherein when the developer supply container is mounted and demounted, the openable cover is opened, the developer accommodating container being usable with an electrophotographic image forming apparatus. The developer supply container includes a developer accommodating portion for accommodating the developer; a supply opening for supplying the developer accommodated in the developer accommodating portion to the developer accommodating container; a seal member for openably sealing the supply opening; a closing member for closing the openable cover, while the developer supply container is mounted in the developer accommodating container, wherein when the developer supply container is not mounted in the developer accommodating container, the openable cover is not closable.

63 Claims, 20 Drawing Sheets

TONER SUPPLY CONTAINER, PROCESS CARTRIDGE AND ELECTROPHOTOGRAPHIC IMAGE FORMING APPARATUS

This application is a continuation of application Ser. No. 08/629,754, filed Apr. 9, 1996, now abandoned.

FIELD OF THE INVENTION

The present invention relates to a refill toner container, a process cartridge, and an electro-photographic image forming apparatus.

The process cartridge in this specification is in the form of a cartridge which integrally comprises a charging means, a developing means, a cleaning means, and an electro-photographic photosensitive member, wherein the charging means, the developing means, and the cleaning means are processing means. Also, the processing cartridge may comprise only one of the processing means and the electro-photographic photosensitive member, or may comprise the developing means and the electro-photographic photosensitive member. This process cartridge is removably installable in the main assembly of an electro-photographic image forming apparatus, for example, an electro-photographic copying machine, an electro-photographic printer, a word processor, or the like, which forms an image on recording medium.

DESCRIPTION OF THE RELATED ART

A conventional image forming apparatus based on an electro-photographic image formation process employs a process cartridge system. According to this system, an electro-photographic photosensitive member, and one or more processing means which act on the electro-photographic photosensitive member, are integrated in the form of a cartridge which is removably installable in the main assembly of an image forming apparatus. This system remarkably improves the operational efficiency of the image forming apparatus since it allows a user to maintain the apparatus without relying on maintenance personnel. Therefore, the process cartridge system is widely used in the field of the image forming apparatus.

It is known that some process cartridges employed in the cartridge system are enabled to be replenished with toner (see, e.g., U.S. Pat. No. 5,034,776, Japanese Laid-Open Patent Application No. 186,375/1990, and the like).

The aforementioned U.S. Pat. No. 5,034,776, and Japanese Laid-Open Patent Application No. 186,375/1990 disclose process cartridges which allow a plurality of refill toner containers to be inserted in their internal space.

The conventional technologies mentioned in the aforementioned patent or patent application are very effective when used with the toner replenishable process cartridge.

The present invention resulted from the further development of the aforementioned technologies.

SUMMARY OF THE INVENTION

A primary object of the present invention is to provide a refill toner container capable of preventing users from forgetting to mount a refill toner container into a process cartridge and a developing device, or the like, as well as a process cartridge and an electro-photographic image forming apparatus, which are capable of preventing users from forgetting to mount the refill toner container.

Another object of the present invention is to provide a refill toner container, a process cartridge, and an electro-photographic image forming apparatus, which make it possible to easily determine whether or not a refill toner container has been mounted in a process cartridge, a developing device, or the like.

Another object of the present invention is to provide a refill toner container, a process cartridge, and an electro-photographic image forming apparatus, which make it possible to easily recognize that the wrong refill toner container has been mounted in a process cartridge, a developing device, or the like.

Another object of the present invention is to provide a process cartridge, a refill toner container, and an electro-photographic image forming apparatus, which are capable of improving the efficiency of a toner refilling operation.

Another object of the present invention is to provide a process cartridge, a refill toner container, and an electro-photographic image forming apparatus, which enable toner to be refilled without causing the toner to be scattered.

Another object of the present invention is to provide a process cartridge, a refill toner container, and an electro-photographic image forming apparatus, which allow the refill toner container to be kept in a toner storing container.

According to an aspect of the present invention, there is provided a developer supply container for supplying a developer for developing a latent image formed on the photosensitive member, wherein the container is inserted into a developer accommodating container which is provided in a process cartridge, through an entrance opening, and the developer is supplied while the container is in the developer accommodating container, and wherein the entrance opening is covered by an openable cover, and wherein when the developer supply container is mounted and demounted, the openable cover is opened, the developer accommodating container being usable with an electrophotograpic image forming apparatus. The developer supply container, comprises a developer accommodating portion for accommodating the developer; a supply opening for supplying the developer accommodated in the developer accommodating portion to the developer accommodating container; a seal member for openably sealing the supply opening; and a closing member for closing the openable cover, while the developer supply container is mounted in the developer accommodating container, wherein when the developer supply container is not mounted in the developer accommodating container, the openable cover is not closable.

According to another aspect of the present invention, there is provided a developer supply container for supplying a developer for developing a latent image formed on the photosensitive member, wherein the container is inserted into a developer accommodating container through an entrance opening, and the developer is supplied while the container is in the developer accommodating container, and wherein the entrance opening is covered by an openable cover, and wherein when the developer supply container is mounted and demounted, the openable cover is opened, the developer accommodating container is usable with an electro-photograpic image forming apparatus. The process cartridge contains an electrophotograpic photosensitive member and process means actable on the electrophotograpic photosensitive member, the process cartridge being detachably mountable to a main assembly of the electro-photograpic image forming apparatus, and the process means including at least one of developing means. The charging means and cleaning means, the developer supply container comprises a developer accommodating portion for accommodating the developer; a supply opening for supplying the developer accommodated in the developer accommodating portion to the developer accommodating container; a seal member for openably sealing the supply opening; and a closing member for closing the openable cover, while the developer supply container is mounted in the developer accommodating container, wherein when the developer supply container is not mounted in the developer accommodating container, the openable cover is not closable.

According to a further aspect of the present invention, there is provided a process cartridge detachably mountable to a main assembly of an image forming apparatus, wherein the process cartridge is provided with a developer accommodating container which can be supplied with a developer by a developer supply container. The developer supply container comprises an electrophotograpic photosensitive member; process means actable on the electrophotograpic photosensitive member; a developer accommodating container for accommodating the developer for developing a latent image formed on the electrophotograpic photosensitive member; an entrance opening for permitting the developer supply container to enter the developer accommodating container; a cap for openably closing the entrance opening; a locking member, provided in the developer accommodating container, for locking the developer supply container; and a blocking member movable between a blocking position for blocking closing of the cap and a retracted position for permitting closing of the cap. The blocking member is disposed in a movement path of the developer supply container from the entrance opening to the locking member; and, when the developer supply container is in engagement with the locking member, the engaging member of the developer supply container is engaged with the blocking member to retract the blocking member to the retracted position, thus permitting closing of the cap.

These and other objects, features and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
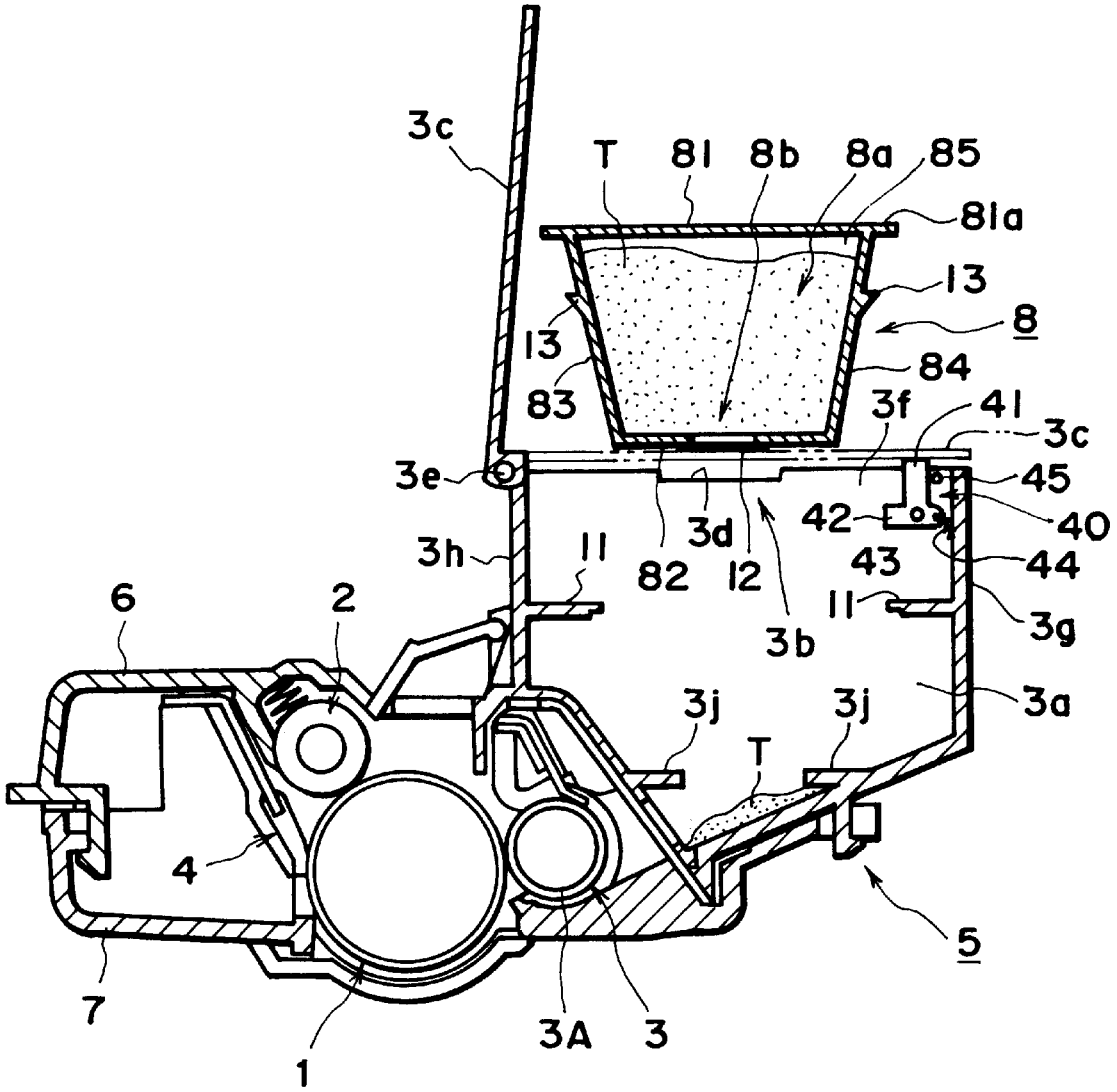
FIG. 1 is a sectional view of a process cartridge in the first embodiment of the present invention.

Hereinafter, an electro-photographic image forming apparatus, a process cartridge, a developing device, and a refill toner container, which are in accordance with the present invention, will be described in detail with reference to the drawings.

EMBODIMENT 1

First, referring to FIG. 6, a typical electro-photographic image forming apparatus usable with a process cartridge 5 structured according to the present invention, will be described. The electro-photograpic image forming apparatus in this embodiment happens to be an electro-photographic printer, but the application of the present invention is not limited to an electro-photographic printer.

The image forming apparatus in this embodiment comprises a process cartridge accommodating space for accommodating the process cartridge 5. The process cartridge 5 typically comprises an electro-photograpic photosensitive member in the form of a drum, that is, a photosensitive drum 1, and image forming processing means such as a charging means 2, a developing means 3, and/or a cleaning means, which are disposed around the photosensitive drum 1. These components are integrally united by plastic frame members 6 and 7.

The process cartridge 5 can be installed into, or removed from, the main assembly of an image forming apparatus, aided by the cartridge installing means 100 provided within the image forming apparatus. It is installed into, or removed from, the apparatus main assembly in the following manner.

First, the lid 14 of the apparatus main assembly is opened. More specifically, the apparatus main assembly is provided with a lid rotatably attached to the top portion of the apparatus main assembly, with the use of a hinge 14*a*. As the apparatus main assembly lid 14 is opened, the cartridge accommodating space provided within the apparatus main assembly is exposed. The process cartridge 5 is inserted into the apparatus main assembly through the opening 14*b* of the apparatus main assembly, and is held by the installing means 100 in the image forming apparatus.

Also within the apparatus main assembly, a transfer charging means 15 is disposed below the photosensitive drum 1. On the sheet feeding side of this transfer charging means 15, a sheet feeder tray 16, a sheet feeder roller 17, and a registration roller 18 are disposed, whereas on the sheet discharging side of the transfer charging means 15, a sheet guide 19 and a conveyer roller 20 are disposed. Also on the sheet discharging side of the transfer charging means 15, a fixing means 21, a discharge guide, a discharge roller 23, and a sheet catcher tray 24 are disposed.

Figure 6:
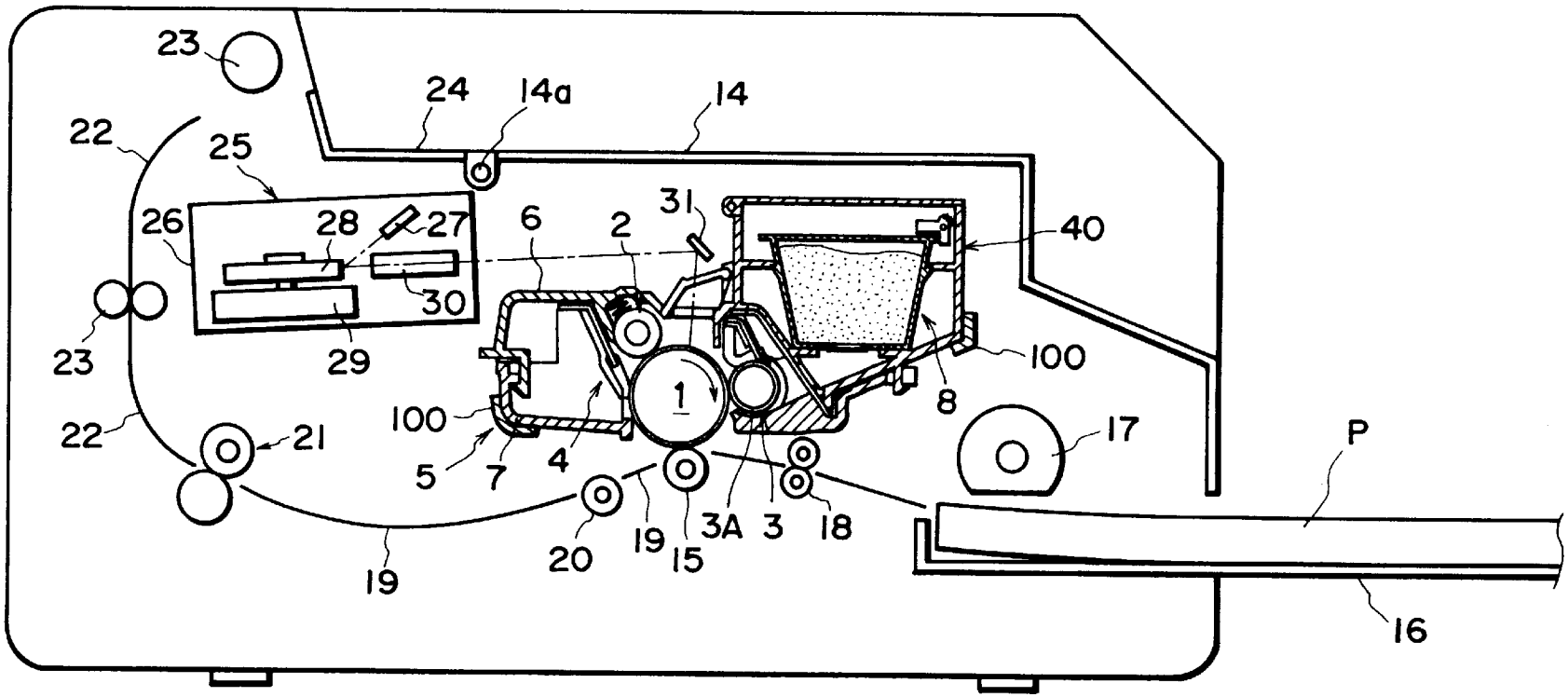
FIG. 6 is a sectional view of a typical image forming apparatus usable with the process cartridge in accordance with the present invention, depicting the general structure thereof.

Also referring to FIG. 6, on the left side of the process cartridge 5, an optical system 25 is disposed, which projects an optical image reflecting image data onto the photosensitive drum 1. The optical system comprises a laser diode 27, a polygon mirror 28, a scanner motor 29, and an image forming lens 30, which are contained in an optical unit 26.

As an image forming signal is sent in from an external device such as a computer, a word processor, or the like, the laser diode 27 of the optical system emits a light beam in response to the image forming signal, and this beam is projected as an image forming beam onto the photosensitive drum 1 by way of the polygon mirror 28; the polygon mirror 28 is in a state of being rotated at a high speed by the scanner motor 29, wherein the image forming beam reflected by the polygon mirror 28 is projected onto the photosensitive drum 1, which is being rotated, through the image forming lens 30, and a deflection mirror 31.

The surface of the photosensitive drum 1 is uniformly charged by the charging means 2, and as it is selectively exposed to the image forming beam projected from the optical system in response to the image data, an electrostatic latent image reflecting the image data is formed. With the rotation of the photosensitive drum 1, this electrostatic latent image is moved to a position at which it faces the developing means 3. The developing means 3 comprises a development sleeve 3A for carrying developer (toner). The latent image on the photosensitive drum 1 is developed into a toner image, that is, a visible image, by the toner which is transferred onto the latent image from this development sleeve 3A.

Meanwhile, a recording medium P such as a transfer sheet in the sheet feeder tray 16 is sent to the registration roller 18 by the sheet feeder roller 17, and then is delivered to the nip between the photosensitive drum 1 and the transfer charging means 15 in synchronism with the toner image by the registration roller 18. In the nip, the toner image on the photosensitive drum 1 is transferred onto the recording medium P by the function of the transfer charging means 15.

Thereafter, the recording medium P carrying the transferred toner image is sent to the fixing means 12 by the sheet guide 19 and the conveyer roller 20. In the fixing means 12, the toner image is fixed to the recording medium P, becoming a permanent image. Then, the recording medium P carrying the permanent toner image is discharged into the sheet catcher tray 24 by the discharge guide 22 and the discharge roller 23.

After the transfer of the toner image, the photosensitive drum 1 is cleaned of the residual toner by the cleaning means 4, and is subjected to the following image forming process.

Next, the process cartridge 5 in accordance with the present invention will be further described.

Referring to FIGS. 1–5, the details of the aforementioned process cartridge 5 will be described. The process cartridge 5 in this embodiment comprises an electro-photographic photosensitive member in the form of, for example, a drum, that is, a photosensitive drum 1, and a minimum of one processing means.

The processing means in this embodiment includes, for example, a charging means 2 for charging the surface of the photosensitive drum 1, a developing means 3 for forming a toner image on the photosensitive drum 1, a cleaning means 4 for removing the toner remaining on the surface of the photosensitive drum 1, and the like. Referring to FIG. 1, in the case of the process cartridge 5 of this embodiment, a charging means 2 (charge roller 2), a developing means 3 containing the toner (developer), and a cleaning means 4 (cleaning blade 4) are disposed around an electro-photographic photosensitive drum 1. They are integrated in a housing constituted of frames 6 and 7, forming a cartridge which is removably installable in the main assembly of an image forming apparatus.

Next, the developing means 3 will be described. The developing means 3 is provided with a developer (toner) holding portion 3*a* for storing toner. The wall surface of the developing means 3 is provided with a claw 11, and an opening 3*b* which is above the claw 11. The opening 3*b* is provided with a lid 3*c* rotatively attached to the process cartridge 5 with the use of a hinge 3*e*. FIG. 1 depicts a state in which the lid 3*c* is open.

In this embodiment, a blocking member 40 is disposed at a location which is within the toner holding portion 3*a* and is adjacent to the opening 3*b*. This blocking member 40 prevents the toner holding portion lid 3*c* from exposing or covering the opening 3*b* unless a refill toner container 8 in accordance with the specifications is inserted. This will be described next.

Figure 2:
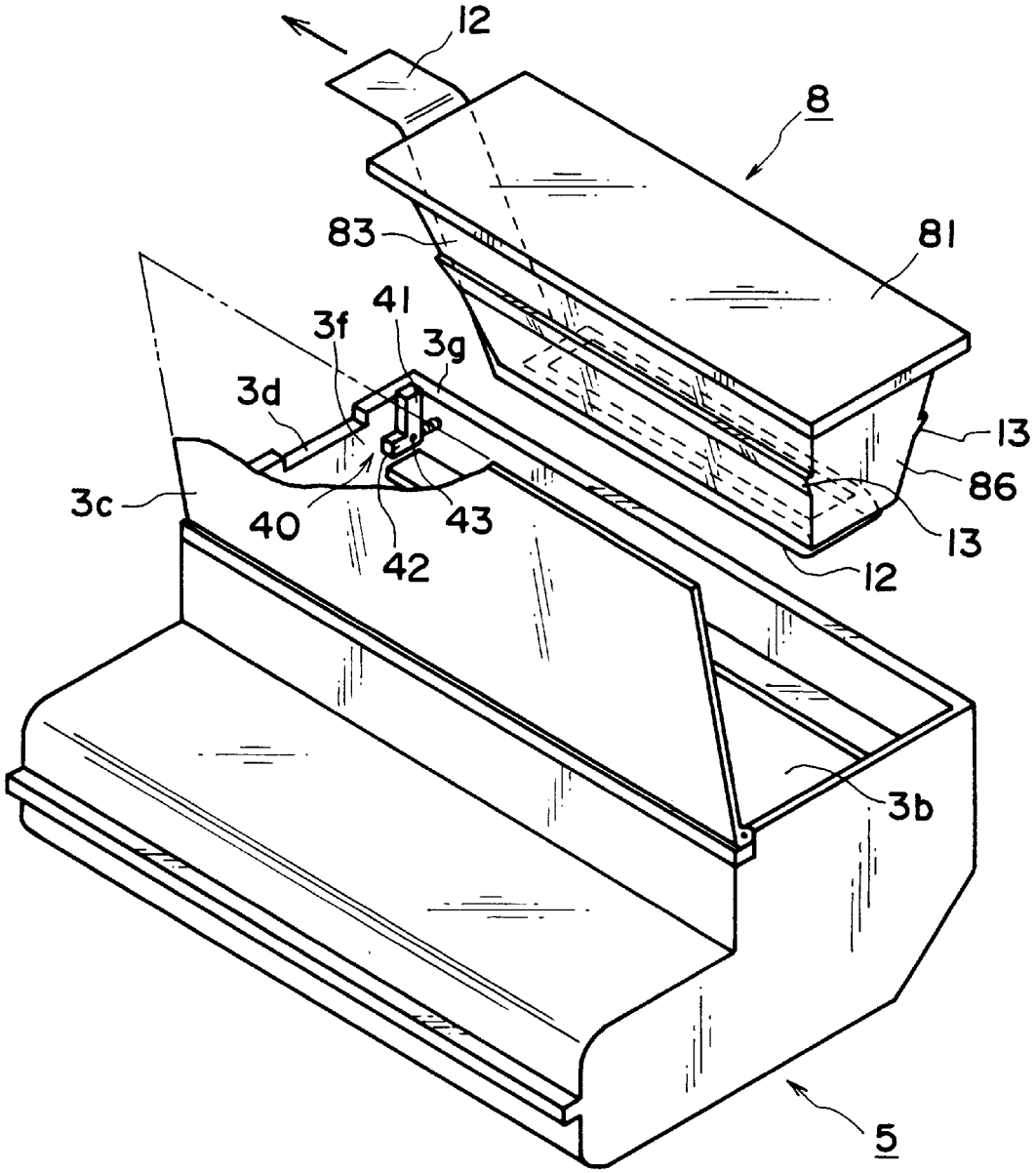
FIG. 2 is a perspective view of the process cartridge illustrated in FIG. 1, depicting how a refill developer container is inserted through the opening of a developer holding portion.
Figure 3:
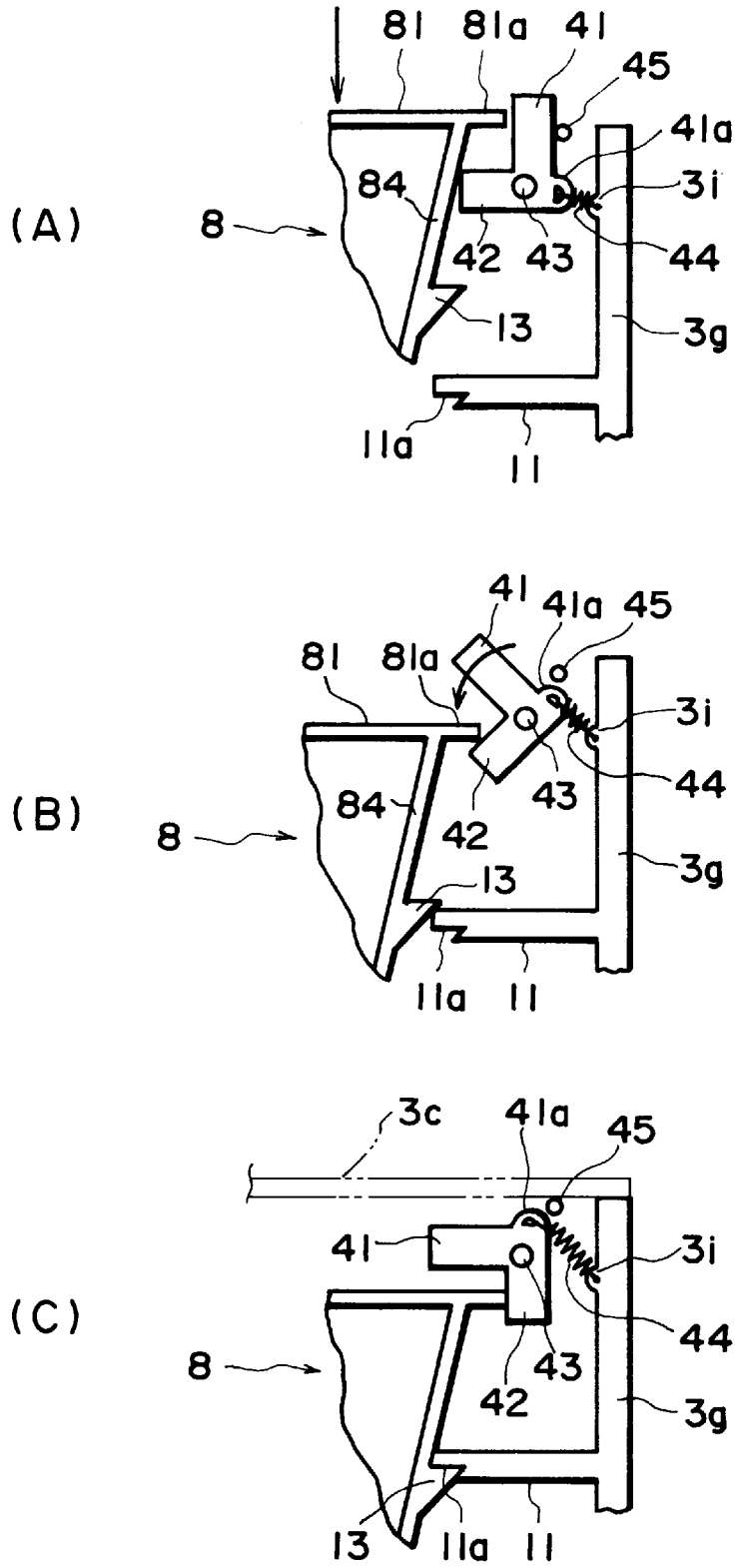
FIGS. 3A, 3B and 3C are explanatory sectional views depicting how a blocking member is driven by the refill developer container.

Referring to FIGS. 2 and 3, which are better suited for describing the blocking member 40, the blocking member 40 comprises first and second arm portions 41 and 42, which are perpendicular to each other. It is oscillatably mounted on the lateral wall 3*f* of the toner holding portion 3*a*, with the use of an axis 43 located at the intersection of the axial lines of the first and second arm portions 41 and 42. Further, a tension spring 44 is stretched between an anchoring portion 41*a* provided on the first arm portion 41, and an anchoring portion 3*i* formed on the rear wall 3*g* of the toner holding portion 3*a*, constantly pulling the blocking member in the clockwise direction of FIGS. 1–3. However, the clockwise rotation of the blocking member 40 is regulated as the blocking member 40 comes into contact with a stopper 45 erected from the lateral wall 3*f* of the toner holding portion 3*a*. Preferably, the stopper is located so that when it regulates the rotation of the blocking member 40, the first arm portion 41 becomes vertical, with its top end projecting above the opening 3*b*, and the second arm portion 42 becomes horizontal.

When an attempt is made to close the toner holding portion lid 3*c* with the blocking member 40 being in the state described in the foregoing, the toner holding portion lid 3*c* cannot be closed completely. This is because the first arm portion 41 of the blocking member 40, which is projecting above the opening 3*b*, interferes with the toner holding portion lid 3*c* as illustrated by the single dot chain line in FIG. 1.

Next, referring to FIGS. 1 and 2, the refill toner container 8 of this embodiment is in the form of a box comprising a top wall 81, a bottom wall 32, a front wall 83, a rear wall 84, and two lateral walls 85 and 86, which form a toner storing portion 8*a*. The bottom wall 82 is rendered smaller than the top wall 81; therefore, the front wall 83, the rear wall 84, and both lateral walls 85 and 86 are inwardly slanted from the top wall side toward the bottom wall side.

The bottom wall 82 is provided with an opening 8*b*, which is sealed with a seal 12. The toner storing space 8*a* is filled with toner T. The outward facing surfaces of the front and rear walls 84 and 85 of the refill toner container 8 are provided with an engagement portion 13 for mounting this container 8 in the process cartridge 5. Referring to FIG. 2 for better understanding, each engagement projection 13 extends across the entire length of the container 8, and one of the engagement portions 13 projects from the front wall 83 of the container 8 across the entire length of the wall, the other projecting from the rear wall 84 of the container 84 in the same manner. Their cross sections are triangular. In this embodiment, their top surfaces are parallel to the top surface of the container 8, and their side walls slant inward. As the container 8 is inserted in the process cartridge 5, the engagement portion 13 engages, with a snapping motion, with a claw 11 provided in the toner holding portion 3*a*, whereby the refill developer container 8 is firmly held in the toner holding portion 3*a*. This will be described later. The claw 11 is disposed on the inward facing surface of the rear and front walls 3*g* and 3*h* of the toner holding portion 3*a*, and extends across the entire length of the rear and front walls 3*g* and 3*h* of the toner holding portion 3*a*. It is elastically deformable. The downward facing surface of the tip portion 11*a* of the claw 11 is stepped in the form of a groove so that it tightly engages with the engagement portion 13 of the container 8.

At this time, how toner is refilled when the toner T within the toner holding portion 3*a* of the process cartridge 5 is completely consumed, will be described.

Figure 3A:
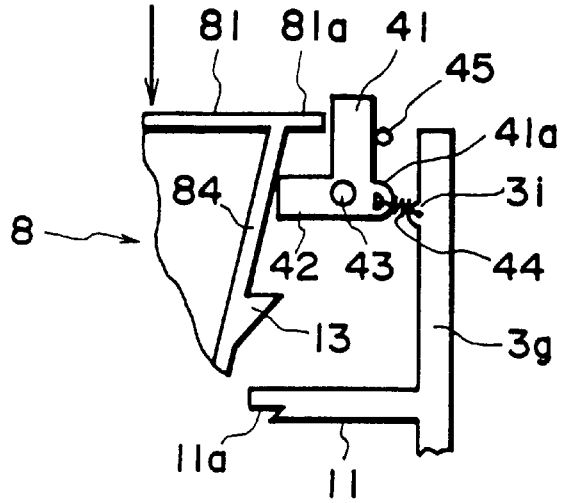
Figure 3B:
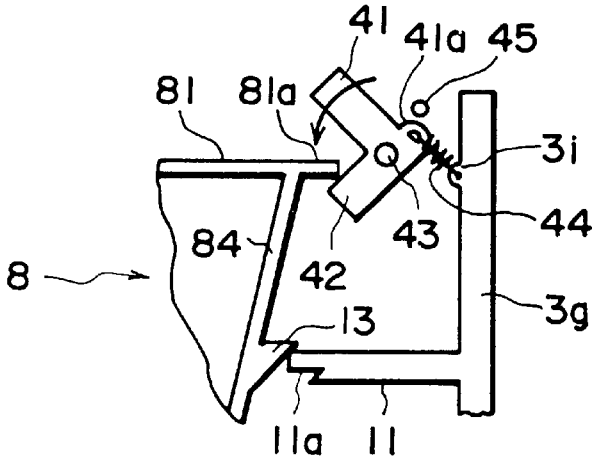
Figure 3C:
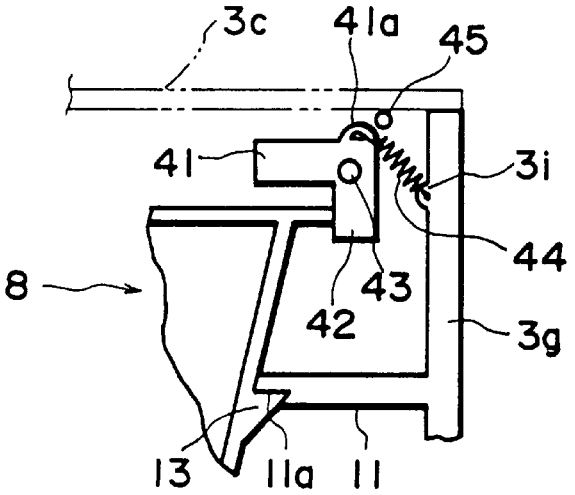

First, referring to FIGS. 1 and 2, the toner holding portion lid 3*c* of the process cartridge 5 is opened to expose the opening 3*b* of the toner holding portion 3*a*. Next, the refill toner container 8 is fitted into the opening 3*b* of the toner holding portion 3*a*, and is pushed downward. At this moment, the blocking member 40 is oriented so that the first arm portion 41 is vertical, and the second arm portion 42 is horizontal as shown in the drawing. Therefore, as the refill toner container 8 is inserted downward a given distance, the driving portion of the refill toner container 8, that is, the outward facing surface of the slanted rear wall 84 of the container 8 in this embodiment, comes into contact with the second arm portion 42 of the blocking member 40 as shown in FIG. 3(A). As the refill toner container 8 is further inserted downward, an extended portion 81*a*, that is, substantially a horizontal outward extension of the top wall 81, of the container 8 engages with the second arm portion 42. As the refill toner container 8 is further inserted, the blocking member 40 is forced to rotate counterclockwise about the axis 43 against the tension of the tension spring 44 as shown in FIG. 3(B). When a refill toner container inserted in the process cartridge happens to be the wrong refill toner container for the process cartridge 5 of this embodiment, such a container is blocked by the blocking member 40, being prevented from entering further.

Figure 4:
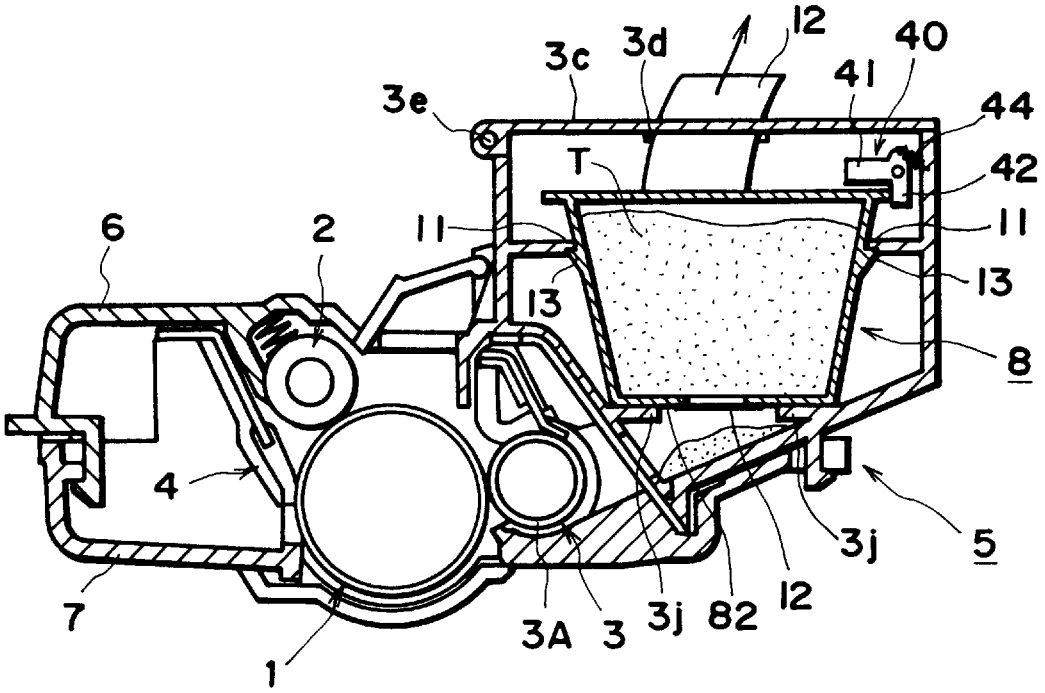
FIG. 4 is a sectional view of the process cartridge illustrated in FIG. 1, a refill developer container having been inserted in the process cartridge.
Figure 5:
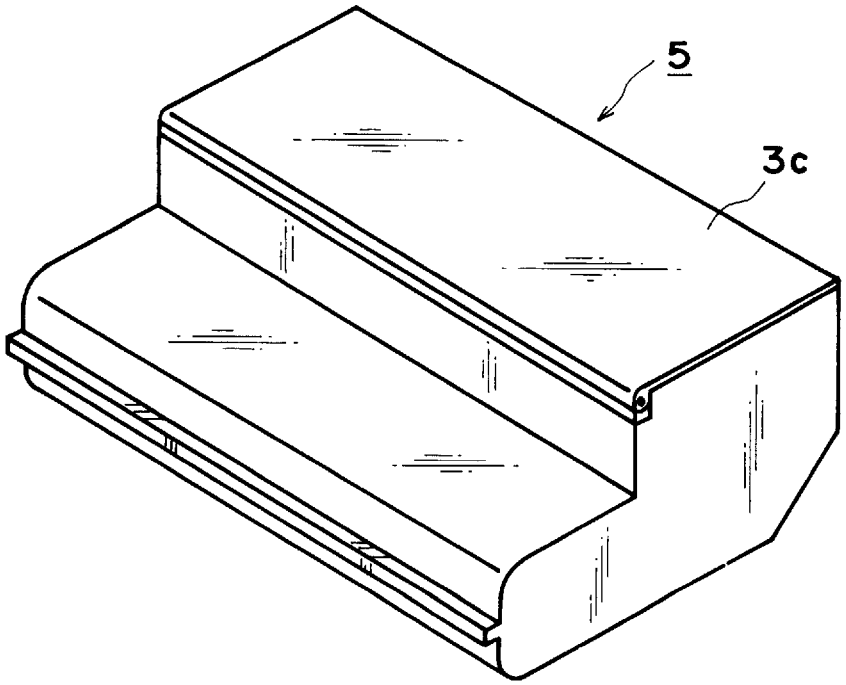
FIG. 5 is a perspective view of the process cartridge illustrated in FIG. 1, with its lid closed.

When a correct refill toner container 8 is inserted, it is allowed to enter further downward, and the engagement portion 13 of the refill toner container 8 comes into contact with the claw 11 of the toner holding portion 3*a*, elastically deforming downward the claw 11 until the engagement portion 13 engages, with a snapping motion, with the claw 11. As a result, the refill toner container 8 is firmly fixed in the toner holding portion 3*a* as shown in FIG. 3(*c*). In this state, the bottom wall 82 of the refill toner container 8 rests on the support wall 3*j* provided within the toner holding portion. 3*a*. Meanwhile, as the refill toner container 8 is inserted, the blocking member 40 is rotated until the first arm portion 41 becomes horizontal; the first arm portion 41 ceases to project above the opening 3*b*. In this state, an attempt to close the toner holding portion lid 3*c* becomes successful; the opening 3*b* can be completely closed as shown in FIGS. 3 and 4. FIGS. 4 and 5 depict a state in which the refill toner container 8 has been completely inserted, and the toner holding portion lid 3*c* has been closed.

Thus, according to this embodiment, not only are users prevented from forgetting to mount the refill toner container 8, but also, the insertion of the wrong refill toner container is prevented.

Referring to FIG. 4, the toner holding portion lid 3*c* is closed with the end portion of the seal 12 projecting from the cutaway portion 3*d* of the developer containing portion. Therefore, the opening 8*b* of the refill toner container 8 can be exposed by pulling the end portion of the seal 12 in the direction of an arrow mark, to release the toner T into the process cartridge 5.

According to this embodiment, once the refill toner container 8 is mounted in the process cartridge 5, with the claw 11 and the engagement portion 13 in engagement as described above, it is impossible to remove the refill toner container 8 from the process cartridge 5. The engagement mechanism provided on the process cartridge 5 side or the developing means 3 side, or provided on both the process cartridge 5 side and the refill toner container 8 side, is not limited to the combination of the claw 11 and the engagement portion 13 employed in this embodiment; its structure is optional.

The process cartridge 5 thus recharged with the toner T is reinstalled into the main assembly of the image forming apparatus, allowing image formation to continue.

EMBODIMENT 2

Figure 7:
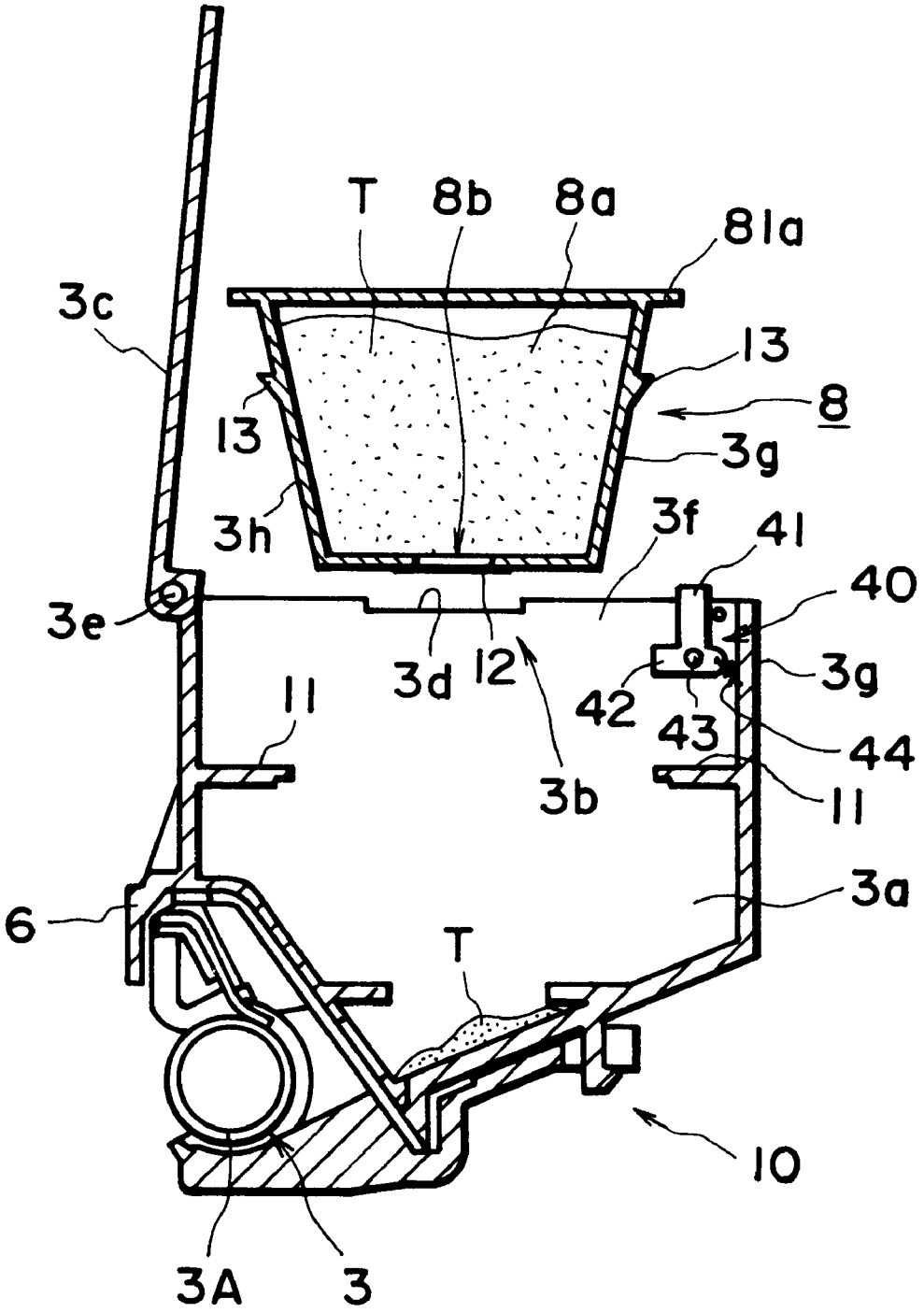
FIG. 7 is a sectional view of the developing device in the first embodiment of the present invention.

FIG. 7 depicts a developing device 10 in accordance with another aspect of the present invention.

The developing device 10 of this embodiment is in the form of a cartridge, and integrally comprises a development sleeve 3A, a developing means 3 with a developer (toner) holding portion 3*a* which contains the toner T to be supplied to the development sleeve 3A, and a plastic frame 6. In other words, the developing device 10 is thought to be substantially the same as the process cartridge 5 described in the first embodiment, except that it lacks the photosensitive drum 1. Therefore, the structures and the functions of the toner holding portion 3*a*, the toner holding portion lid 3*c*, the refill toner container 8, the blocking member 40, and the like components, are the same as the first embodiment, and the components having the same structures and functions are designated with the same reference numerals to substitute their descriptions with those given in the first embodiment. In FIG. 7, the toner holding portion lid 3*c* of the developing device 10 is open, and the refill toner container 8 is being inserted into the developing device 10.

EMBODIMENT 3

Figure 8:
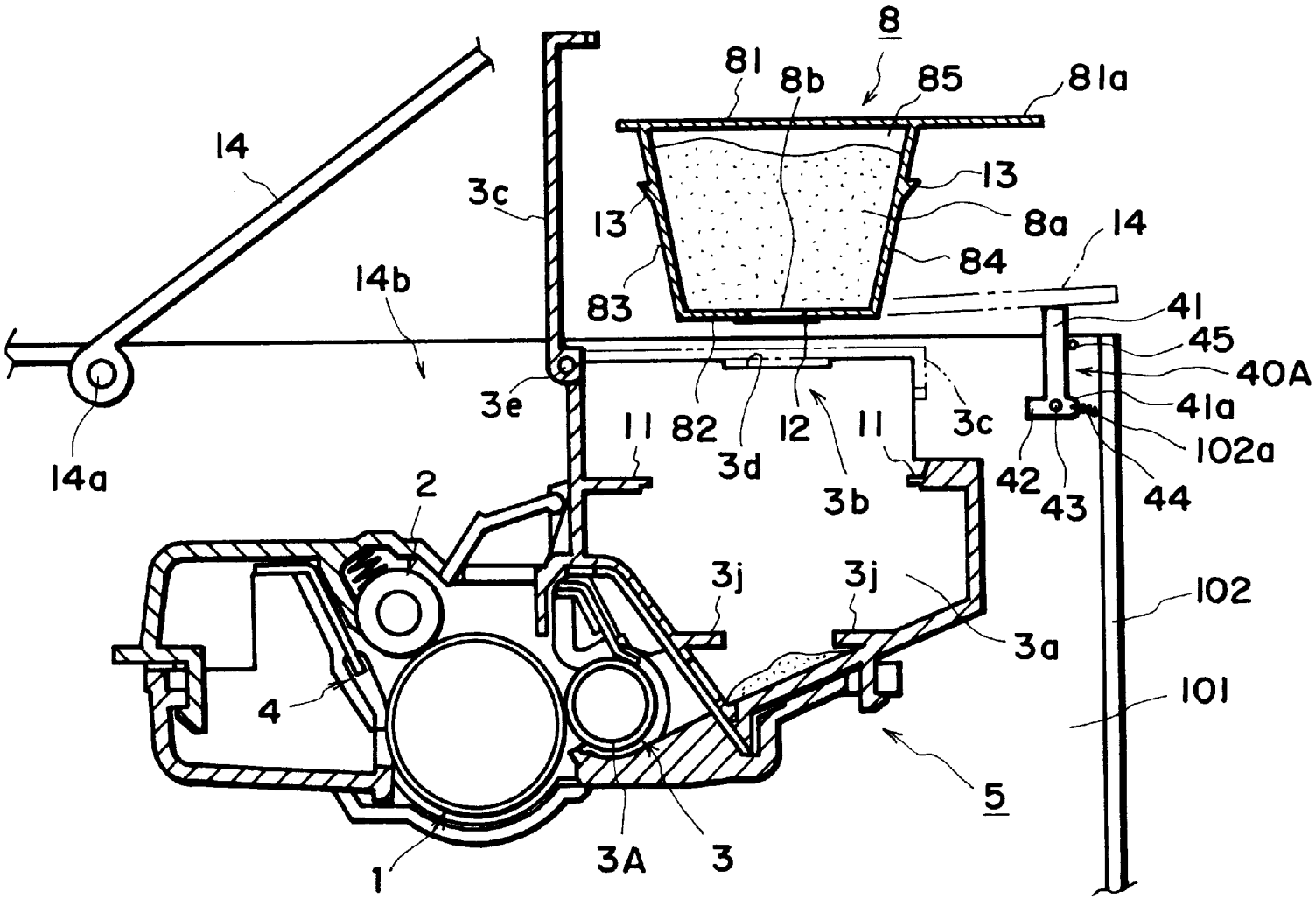
FIG. 8 is a sectional view of the process cartridge in another embodiment of the present invention.
Figure 9:
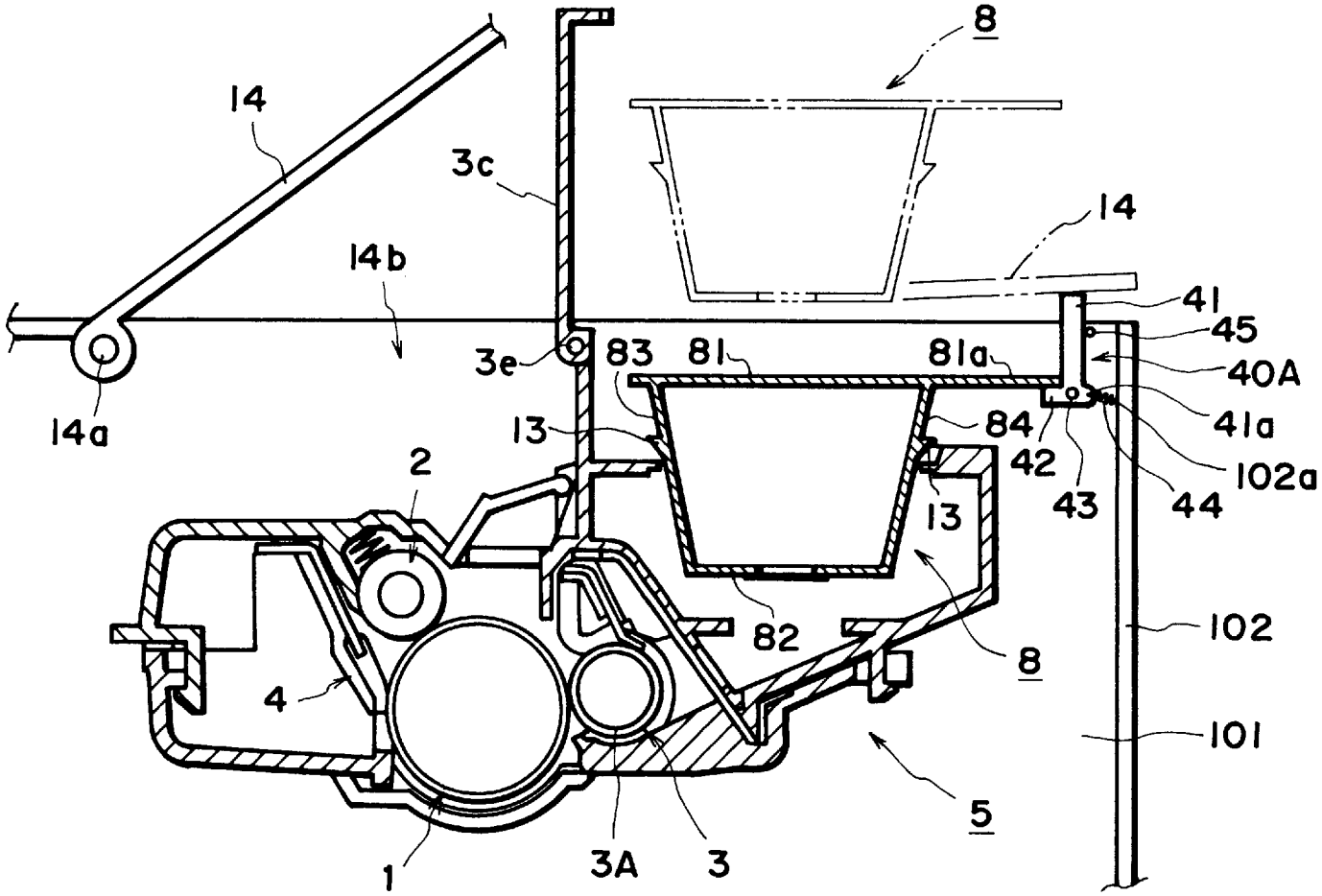
FIG. 9 is an explanatory sectional view depicting how a refill developer container is installed in the process cartridge illustrated in FIG. 8.
Figure 10:
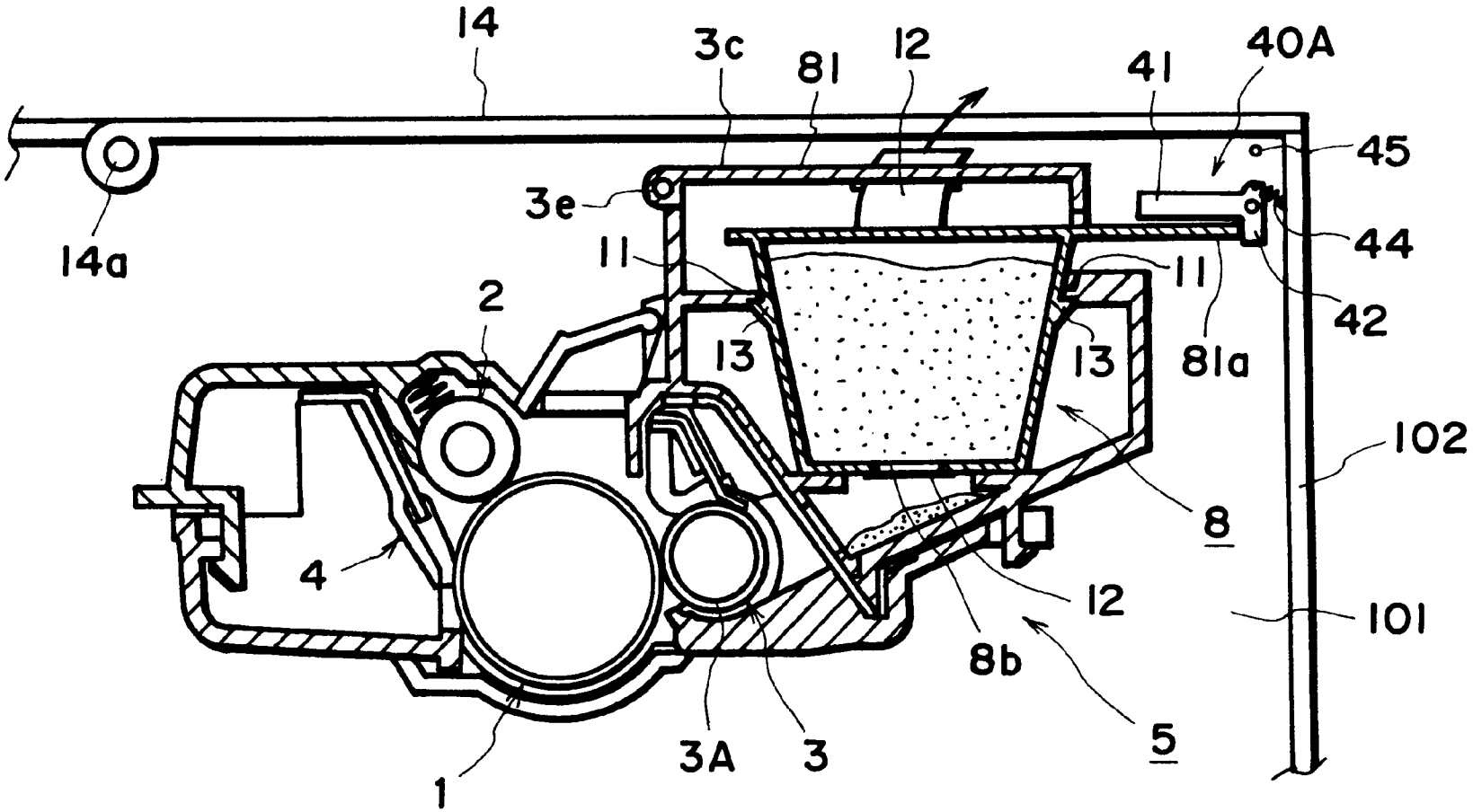
FIG. 10 is a sectional drawing depicting the process cartridge illustrated in FIG. 8, and a refill developer container having been inserted therein.

FIGS. 8, 9 and 10 depict the image forming apparatus, the process cartridge 5, and the refill toner container 8, which are in accordance with another aspect of the present invention.

The refill toner container 8 of this embodiment has the same structure as the refill toner container described with reference to FIGS. 1 and 2; it is in the form of a box comprising a top wall 81, a bottom wall 82, slanted front and rear walls 83 and 84, and two slanted lateral walls 85 and 86, which form a toner storing portion 8*a*. The toner storing portion 8*a* contains toner T. The bottom wall 82 is provided with an opening 82*b* sealed with a seal 12, and the front and rear walls 83 and 84 are provided with an engagement portion 13 for mounting the refill toner container 8 in the process cartridge 5. However, in this embodiment, an extended portion 81*a*, that is, substantially the horizontal outward extension of the top wall 81 of the container 8, projects further than the counterparts in the preceding embodiments.

There is another difference, which is that the blocking member 40A of this embodiment is located outside the toner holding portion 3*a* of the process cartridge 5, being close to the opening 3*b*, as well as the opening 14*b* of the apparatus main assembly, through which the process cartridge 5 is inserted. This blocking member 40A prevents the opening 14*b* of the apparatus main assembly from being closed unless a correct refill toner container 8 is inserted into the process cartridge 5.

This blocking member 40A is given the same structure as the aforementioned blocking member 40; it comprises perpendicularly intersecting first and second arm portions 41 and 42, and is oscillatably mounted on the lateral wall 101 of the apparatus main assembly, with the use of an axis 43 provided at the axial intersection of the arm portions 41 and 42. Further, a tension spring 44 is stretched between an anchoring portion 41*a* provided on the first arm portion 41, and an anchoring portion 102*a* formed on the rear wall 102 of the apparatus main assembly, keeping the blocking member 40A under the tension working in the clockwise direction of FIG. 8. However, the clockwise rotation of the blocking member 40A is regulated as the blocking member 40A comes into contact with a stopper 45 erected from the lateral wall 101 of the apparatus main assembly. Preferably, the stopper 45 is located so that when it regulates the rotation of the blocking member 40, the first arm portion 41 becomes vertical, with its top end projecting above the apparatus main assembly lid 14*b*, and the second portion becomes horizontal.

In the state described in the foregoing, the toner holding portion lid 3*c* can be closed, but the apparatus main assembly lid 14 cannot be closed completely as depicted by the single dot chain line in FIG. 8. This is because the first arm portion 41 of the blocking member 40A, which is projecting above the opening 14*b* of the apparatus main assembly, interferes with the apparatus main assembly lid 14.

At this time, how toner is refilled when the toner T within the toner holding portion 3*a* of the process cartridge 5 is completely consumed, will be described.

First, referring to FIG. 8, the apparatus main assembly lid 14, and the toner holding portion lid 3*c* of the process cartridge 5 are opened to expose the opening 14*b* of the apparatus main assembly, and the opening 3*b* of the toner holding portion 3*a*. Next, the refill toner container 8 is fitted into the opening 3*b* of the toner holding portion 3*a*, and is pushed downward. At this moment, the blocking member 40A is oriented so that the first arm portion 41 is vertical, and the second arm portion 42 is horizontal as shown in the drawing. Therefore, as the refill toner container 8 is inserted downward a given distance, the driving portion of the refill toner container 8, that is, the extended portion 81*a* of the top wall 81 of the container 8, comes into contact with the second arm portion 42 of the blocking member 40A as shown in FIG. 9. As the refill toner container 8 is further inserted downward, the extended portion 81*a* is caused to press downward the second arm portion 42. Consequently, as the refill toner container 8 is further inserted, the blocking member 40A is forced to rotate counterclockwise about the axis 43 against the tension of the tension spring 44 as shown in FIG. 9. When a refill toner container inserted in the process cartridge happens to be the wrong refill toner container for the process cartridge 5 of this embodiment, such a wrong container is blocked by the blocking member 40A, being prevented from entering further.

When a correct refill toner container 8 is inserted, it is allowed to enter further downward, and the engagement portion 13 of the refill toner container 8 comes in contact with the claw 11 of the toner holding portion 3*a*, elastically deforming downward the claw 11 until the engagement portion 13 engages, with a snapping motion, with the claw 11. As a result, the refill toner container 8 is firmly fixed in the toner holding portion 3*a* as shown in FIG. 10. Meanwhile, as the refill toner container 8 is inserted, the blocking member 40A is rotated until the first arm portion 41 becomes horizontal; the first arm portion 41 ceases to project above the opening 14*b*. In this state, an attempt to close the apparatus main assembly lid 14 becomes successful; the opening 14*b* can be completely closed as shown in FIG. 10. FIG. 10 depicts a state in which the refill toner container 8 has been completely inserted in the process cartridge 5, and the apparatus main assembly lid 14 has been closed.

Thus, according to this embodiment, not only are users prevented from forgetting to mount the refill toner container 8, but also, the insertion of the wrong refill toner container is prevented.

Referring to FIG. 10, the toner holding portion lid 3*c* is closed with the end portion of the seal 12 projecting from the cutaway portion 3*d* of the developer containing portion 8. Therefore, the opening 8*b* of the refill toner container 8 can be exposed by pulling outward the end portion of the seal 12, to release the toner T into the process cartridge 5.

EMBODIMENT 4

Figure 11:
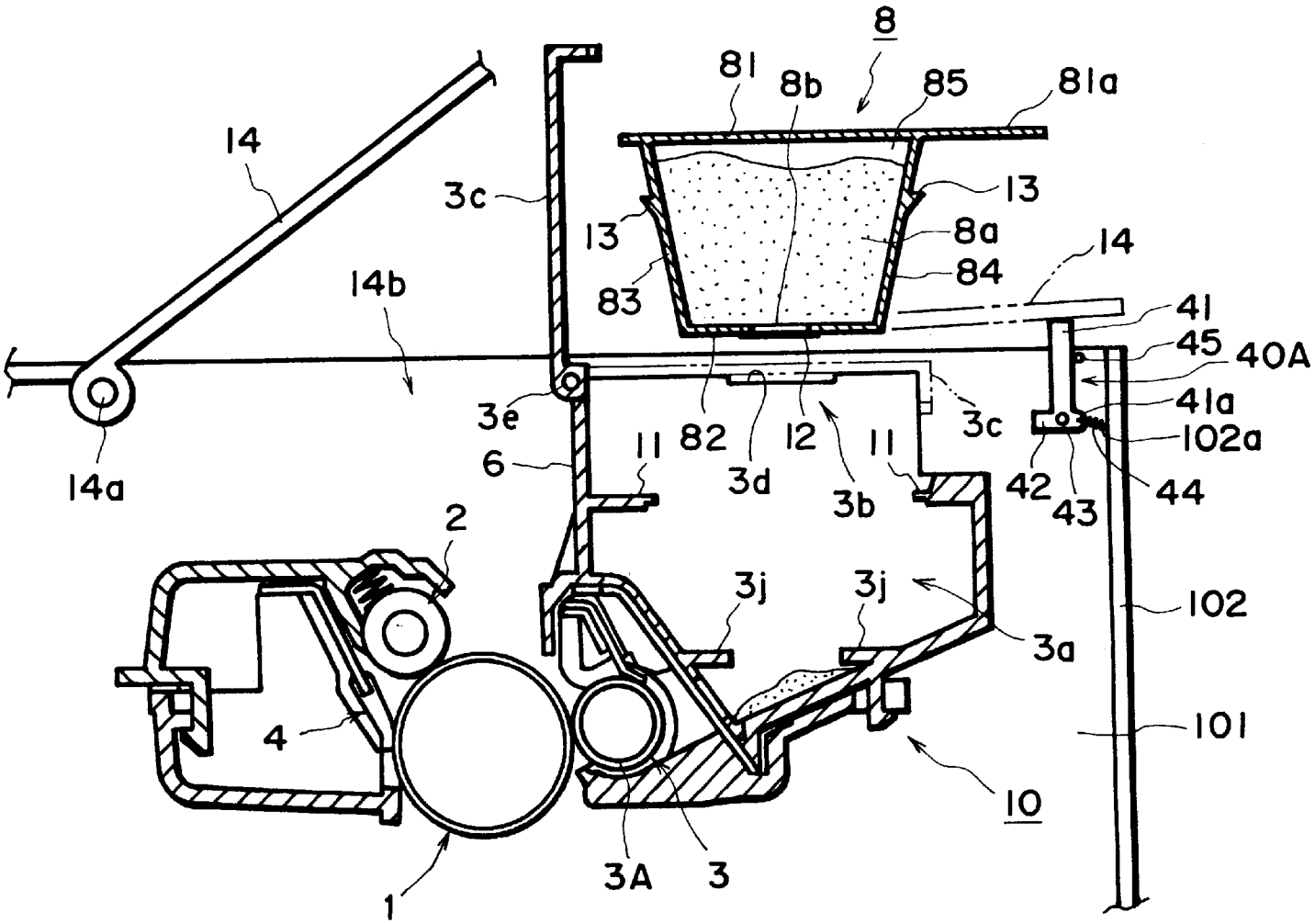
FIG. 11 is a sectional view of the developing device in another embodiment of the present invention.

FIG. 11 depicts the developing device cartridge 10 in accordance with another aspect of the present invention.

The developing device 10 of this embodiment is in the form of a cartridge, and integrally comprises a development sleeve 3A, a developing means 3 with a developer (toner) holding portion 3*a* which contains the toner T to be supplied to the development sleeve 3A, and a plastic frame 6. In other words, the developing device 10 is thought to be substantially the same as the process cartridge 5 described in the third embodiment, except that it lacks the photosensitive drum 1. Therefore, the structures and the functions of the toner holding portion 3*a*, the toner holding portion lid 3*c*, the refill toner container 8, the apparatus main assembly lid 14, the blocking member 40A, and the like components, are the same as the first embodiment, and the components having the same structures and functions are designated with the same reference numerals to substitute their descriptions with those given in the first embodiment. In FIG. 11, the apparatus main assembly lid 14, and the toner holding portion lid 3*c* of the developing device 10 is open, and the refill toner container 8 is being inserted into the developing device 10.

EMBODIMENT 5

FIGS. 12–15 depict the process cartridge 5 in accordance with another aspect of the present invention.

The refill toner container 8 of this embodiment is substantially the same as the refill toner container described with reference to FIGS. 1 and 2; it is in the form of a box comprising a top wall 81, a bottom wall 82, slanted front and rear walls 83 and 84, and two slanted lateral walls 85 and 86, which form a toner storing portion 8*a*. The toner storing portion 8*a* contains toner T. The bottom wall 82 is provided with an opening 82*b* sealed with a seal 12, and the front and rear walls 83 and 84 are provided with an engagement portion 13 for mounting the refill toner container 8 in the process cartridge 5. Further, an extended portion 81*a*, that is, substantially the horizontal outward extension of the top wall 81 of the container 8, horizontally projects beyond the vertical walls.

Figure 12:
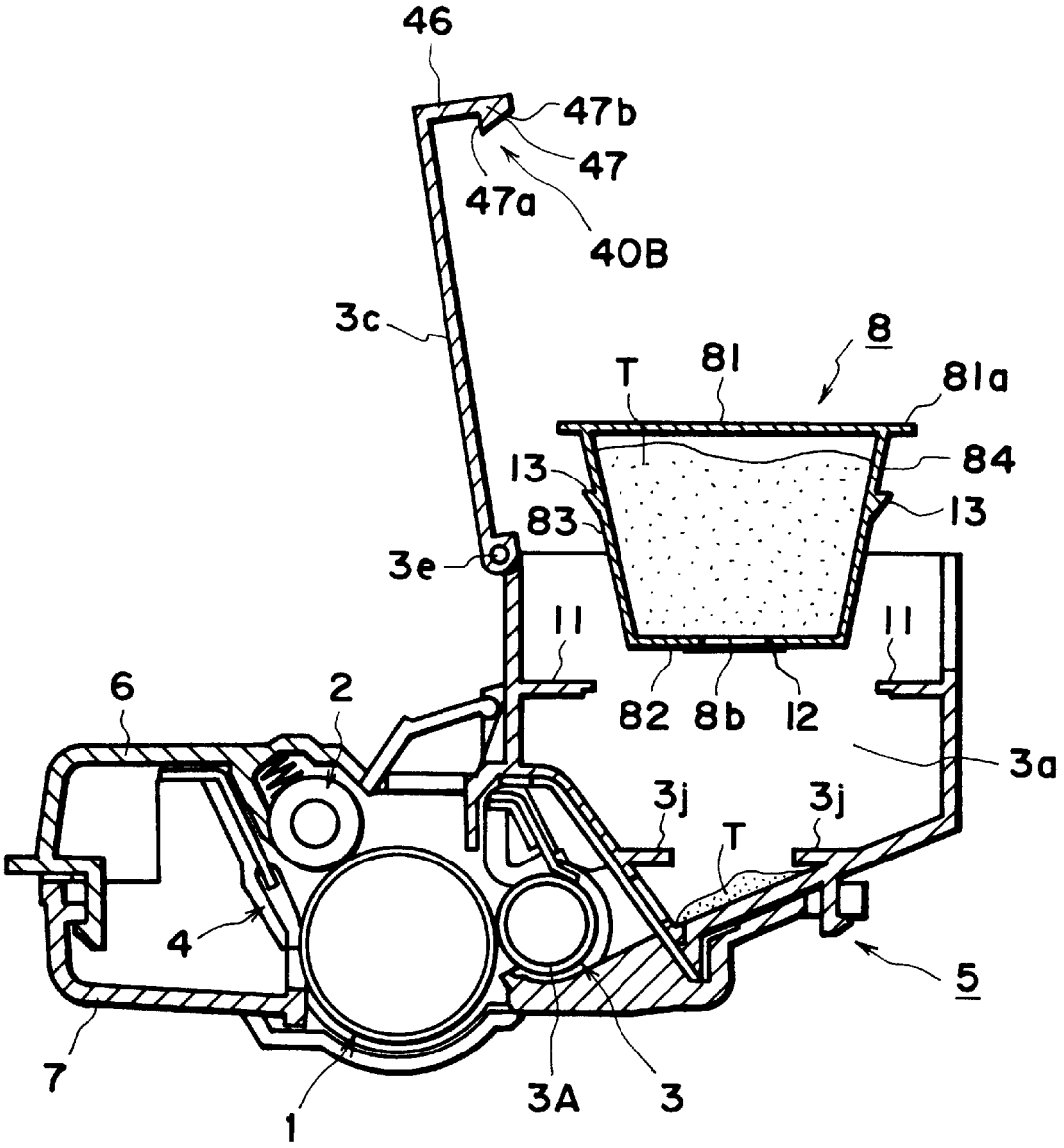
FIG. 12 is a sectional view of the process cartridge in another embodiment of the present invention.

However, there are some differences between the process cartridge 5 in this embodiment and the process cartridge 5 in the first embodiment. That is, in the first embodiment 1, the blocking member 40A was disposed at a location which is adjacent to both the opening 3*b* of the toner holding portion 3*b* and the opening 14*b* of the apparatus main assembly, but in this embodiment, the blocking member 40A is replaced with a blocking member 40B, which is formed at the free end of the toner holding portion lid 3*c* pivotally attached to the wall of the toner holding portion 3*a* with the use of a hinge 3*e*. The blocking member 40B is constituted of an elastically deformable tong portion 46, and a claw portion 47 formed at the end of the tong portion 46. As illustrated in FIG. 12, the claw portion 47 has a flat surface 47*a* which is perpendicular to the tong portion 46, and a surface 47*b* which slants toward the tong portion 46.

At this time, how toner is refilled when the toner T within the toner holding portion 3*a* of the process cartridge 5 is completely consumed, will be described.

First, referring to FIG. 12, the toner holding portion lid 3*c* of the process cartridge 5 is opened to expose the opening 3*b* of the toner holding portion 3*a*. Next, the refill toner container 8 is fitted into the opening 3*b* of the toner holding portion 3*a*, and is pushed downward. As a result, the engagement portion 13 of the refill toner container 8 is caused to elastically deform the claw 11 of the toner holding portion 3*a* in the downward direction. As the refill toner container 8 is further inserted downward, the engagement portion 13 engages with the claw 11 with a snapping motion. As a result, the refill toner container 8 is firmly fixed held in the toner holding portion 3*a* as shown in FIG. 13.

Figure 13:
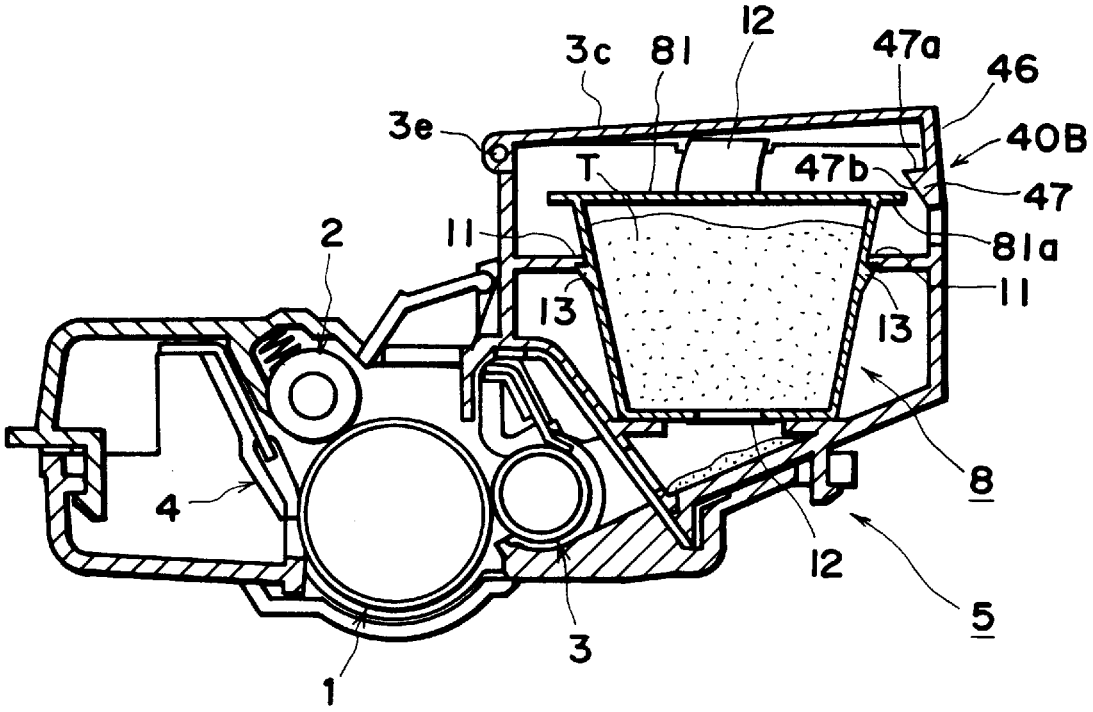
FIG. 13 is a sectional drawing depicting the process cartridge illustrated in FIG. 12, and a refill developer container having been inserted therein.
Figure 14:
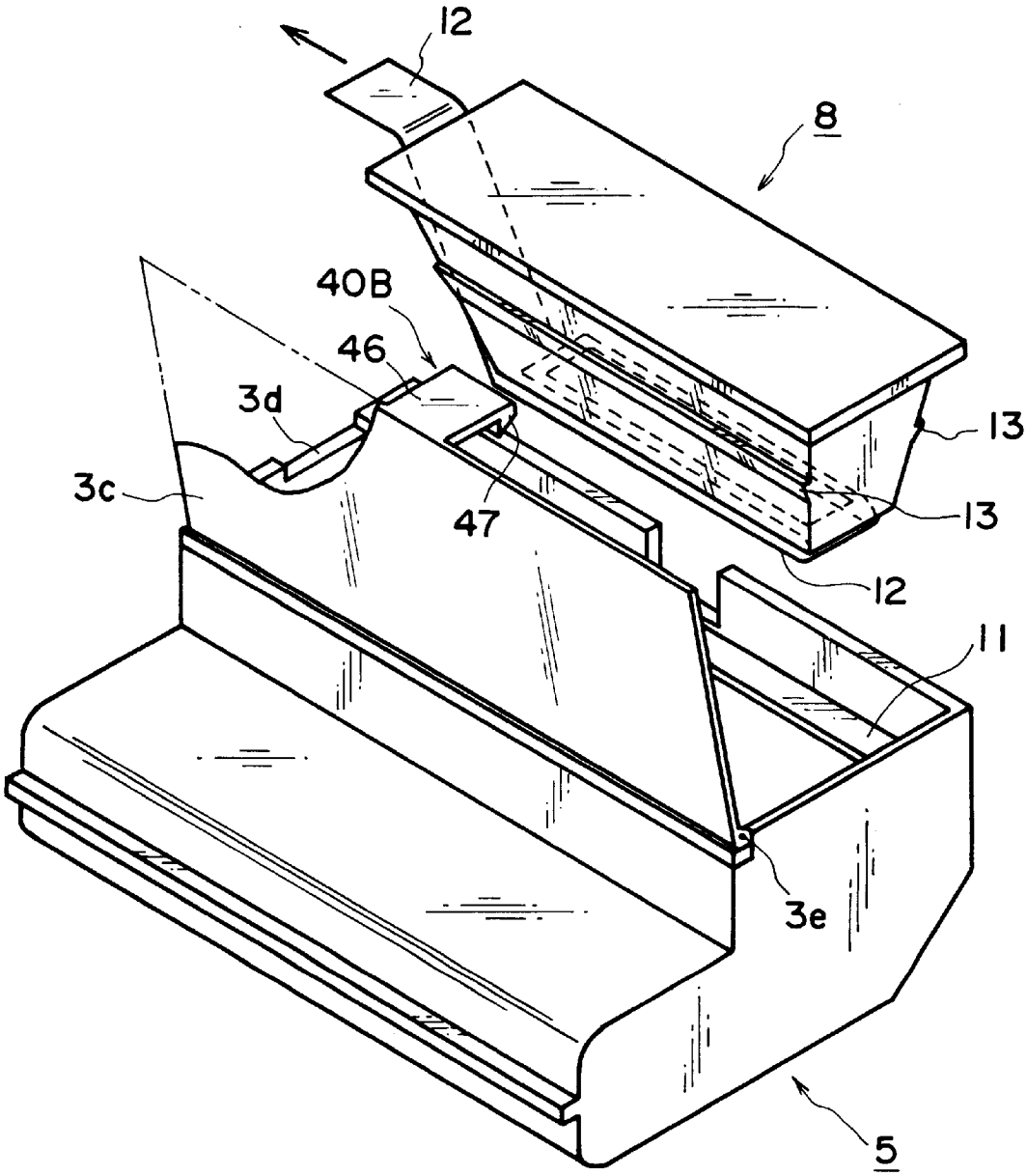
FIG. 14 is a perspective view depicting how a refill developer container is inserted through the opening of the developer holding portion of the process cartridge illustrated in FIG. 12.
Figure 15:
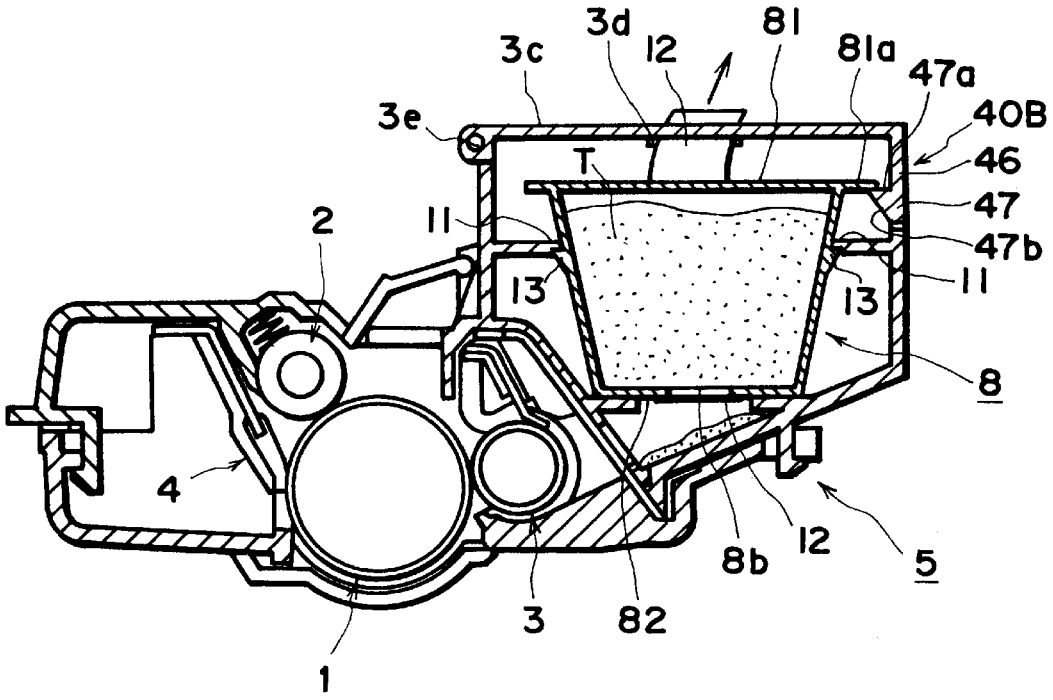
FIG. 15 is a sectional drawing depicting the process cartridge illustrated in FIG. 12, and a refill developer container having been inserted therein.

In this state, the toner holding portion lid 3*c* is rotated to the closed position about the hinge 3*e* as shown in FIG. 13. Then, the slanted surface 47*b* of the claw portion 47 formed on the tong portion 46 of the toner holding portion lid 3*c* comes into contact with the extended portion 81*a* of the top wall 81 of the container 8. As the toner holding portion lid 3*c* is depressed further downward, the tong portion 46 is elastically deformed outward, with the slanted surface 47*b* of the claw portion 47 being guided by the extended portion 81*a*, and finally, the perpendicular surface 47*a* of the claw portion 47 engages with the downward facing surface of the extended portion 81*a* with a snapping motion as illustrated in FIG. 15. As a result, the opening 8*b* of the toner holding portion 3*a* is completely closed by the toner holding portion lid 3*c*. FIG. 15 depicts a state in which the refill toner container 8 has been properly mounted in the process cartridge 5, and the lid 3 has been closed. It is obvious that after the process cartridge 5 described above is mounted in an image forming apparatus, the apparatus main assembly lid 14 also can be completely closed.

When the refill toner container 8 has not been mounted in the process cartridge 5, or when the wrong refill toner container 8 has been inserted in the process cartridge 5, the claw portion 47 cannot be engaged with the refill toner container 8. Therefore, users can be prevented from forgetting to mount the refill toner container 8, and also from mounting the wrong refill toner container 8.

Referring to FIG. 15, the toner holding portion lid 3*c* is closed with the end portion of the seal 12 projecting from the cutaway portion 3*d* of the toner holding portion 3*a*. Therefore, the opening 8*b* of the refill toner container 8 can be exposed by pulling outward the end portion of the seal 12 to release the toner T into the process cartridge 5.

EMBODIMENT 6

Figure 16:
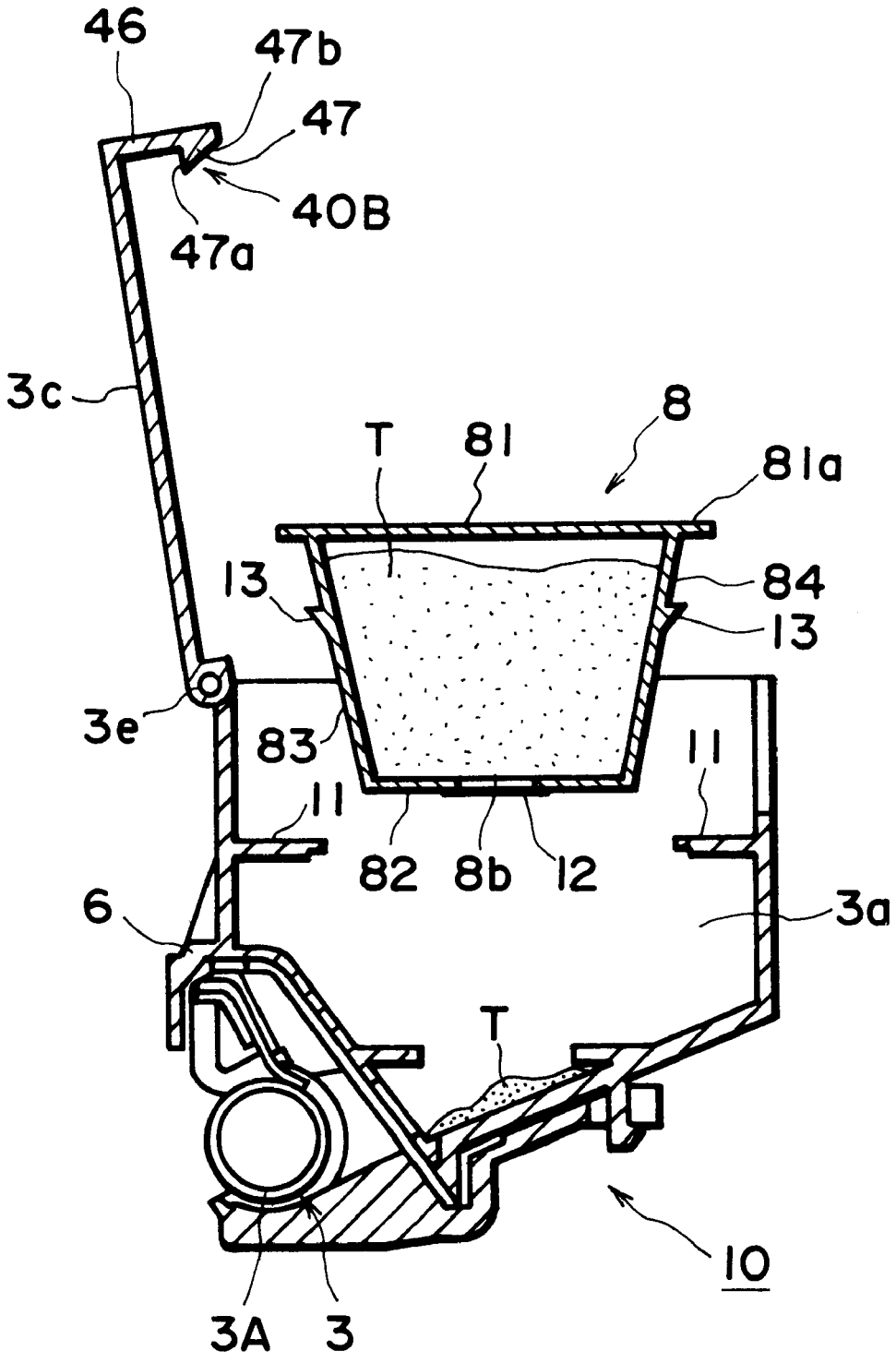
FIG. 16 is a sectional view of the developing device in another embodiment of the present invention.

FIG. 16 depicts the developing device cartridge 10 in accordance with another aspect of the present invention.

The developing device 10 of this embodiment is in the form of a cartridge, and integrally comprises a development sleeve 3A, a developing means 3 with a developer (toner) holding portion 3*a* which contains the toner T to be supplied to the development sleeve 3A, and a plastic frame 6. In other words, the developing device 10 is thought to be substantially the same as the process cartridge 5 described in the fifth embodiment, except that it lacks the photosensitive drum 1. Therefore, the structures and the functions of the toner holding portion 3*a*, the toner holding portion lid 3*c*, the refill toner container 8, the blocking member 40B, and the like components, are the same as the fifth embodiment, and the components having the same structures and functions are designated with the same reference numerals to substitute their descriptions with those given in the fifth embodiment. In FIG. 16, the toner holding portion lid 3*c* of the developing device 10 is open, and the refill toner container 8 is being inserted into the developing device 10.

EMBODIMENT 7

Figure 17:
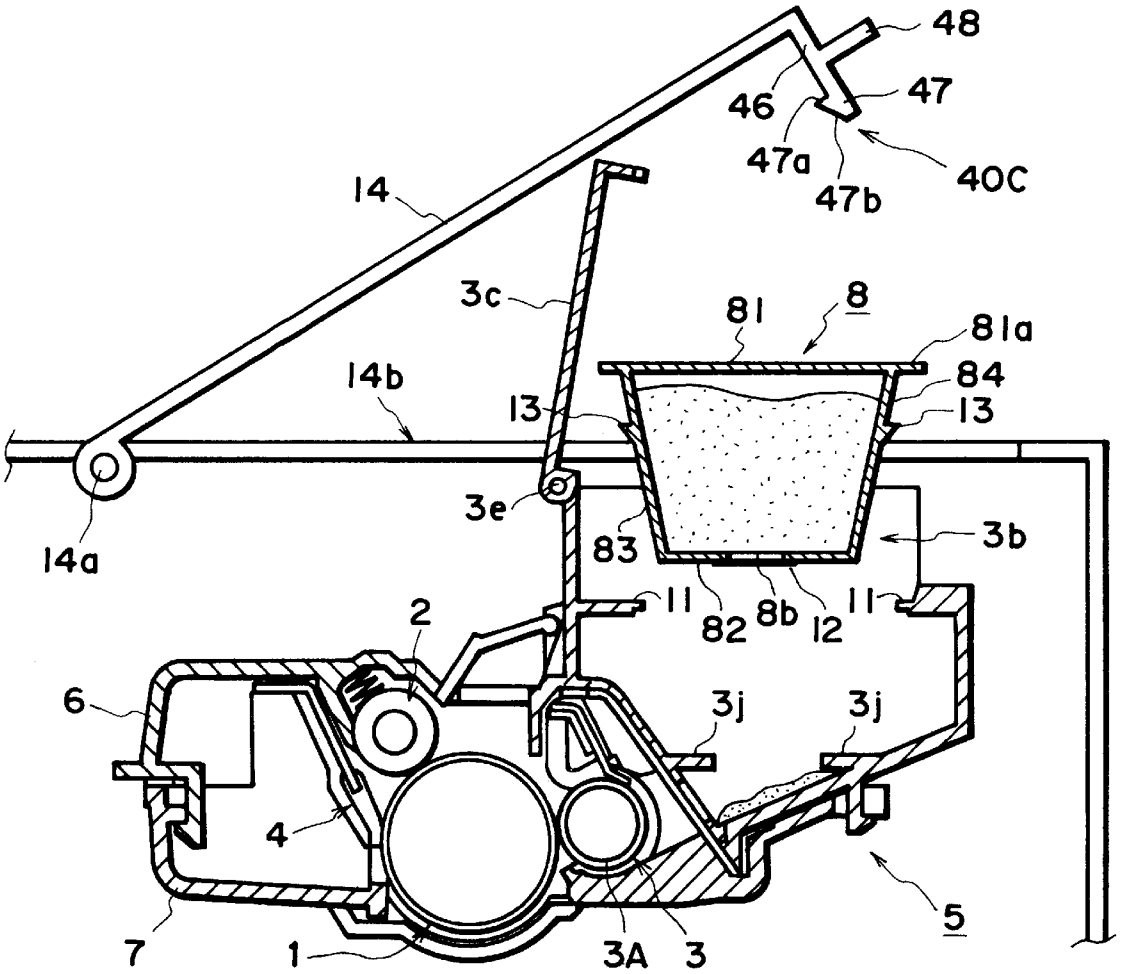
FIG. 17 is a sectional view of the process cartridge in another embodiment of the present invention.
Figure 18:
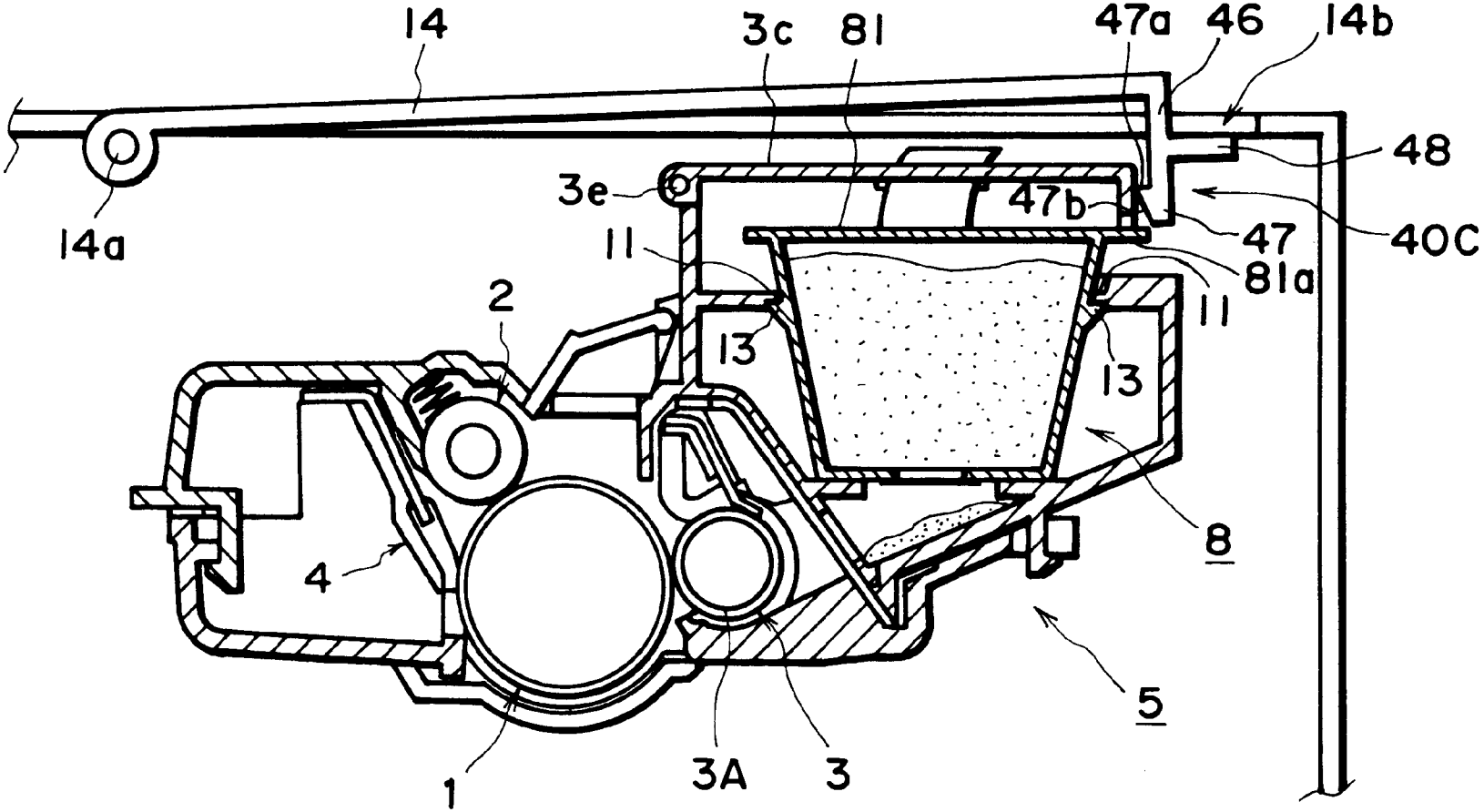
FIG. 18 is a sectional drawing depicting how a refill developer container is inserted into the process cartridge illustrated in FIG. 17.
Figure 19:
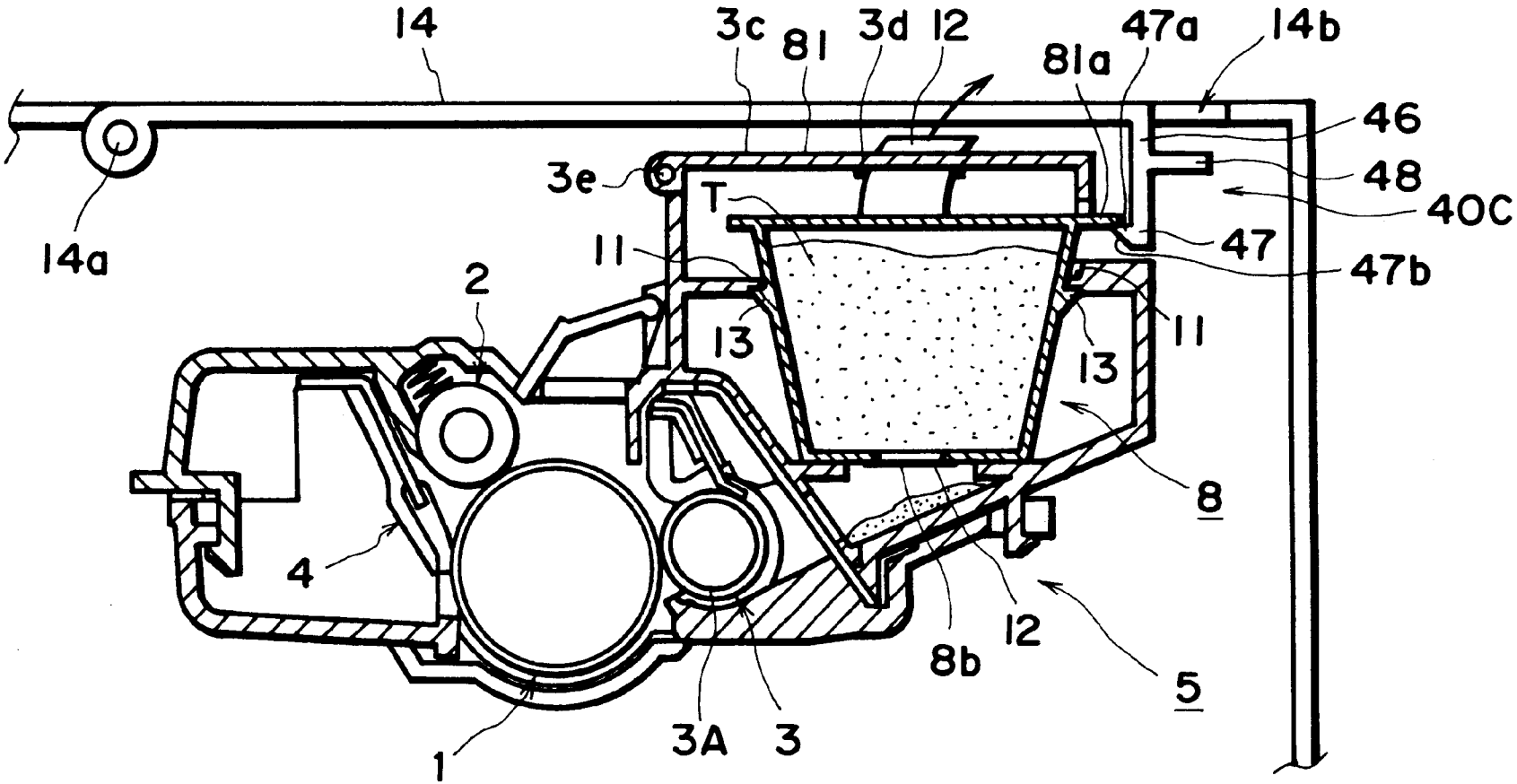
FIG. 19 is a sectional drawing depicting the process cartridge illustrated in FIG. 17, and a refill developer container having been inserted therein.

FIGS. 17, 18 and 19 depict the image forming apparatus and the process cartridge 5 in another aspect of the present invention.

The refill toner container 8 and the process cartridge 5 of this embodiment are substantially the same as those described in the fifth embodiment, except that in the fifth embodiment, the blocking member 40B was formed at the free end edge of the toner holding portion lid 3*c*, but in this embodiment, the blocking member 40C is formed on the apparatus main assembly lid 14.

In other words, the blocking member 40C is formed at the free end of the apparatus main assembly lid 14, pivotally attached to the wall of the apparatus main assembly with the use of a hinge 3*a*. The blocking member 40C is given the same structure as the blocking member 40B of the fifth embodiment; it is constituted of an elastically deformable tong portion 46 perpendicular to the apparatus main assembly lid 14, and a claw portion 47 formed at the end of the tong portion 46. The claw portion 47 has a flat surface 47*a* which is perpendicular to the tong portion 46, and a surface 47*b* which slants toward the tong portion 46. Further, in this embodiment, the tong portion 46 is provided with a knob 48.

At this time, how toner is refilled when the toner T within the toner holding portion 3*a* of the process cartridge 5 is completely consumed, will be described.

First, referring to FIG. 17, the apparatus main assembly lid 14, and the toner holding portion lid 3*c* of the process cartridge 5 are opened to expose the opening 14*b* of the apparatus main assembly, and the opening 3*b* of the toner holding portion 3*a*. Next, the refill toner container 8 is fitted into the opening 3*b* of the toner holding portion 3*a*, and is pushed downward. Then, the engagement portion 13 of the refill toner container 8 is caused to elastically deform the claw 11 in the downward direction until the engagement portion 13 engages, with a snapping motion, with the claw 11. As a result, the refill toner container 8 is firmly fixed in the toner holding portion 3*a* as shown in FIG. 18.

In this state, the toner holding portion lid 3*c* is rotated to the closed position about the hinge 3*e*, closing the opening 3*b* of the toner holding portion 3*a*.

Next, the apparatus main assembly lid 14 is rotated to the closed position about the hinge 14*a*. With this action, the slanted surface 47*b* of the claw portion 47 formed on the tong portion 46 of the apparatus main assembly lid 14 comes into contact with the extended portion 81*a* of the top wall 81 of the container 8. As the apparatus main assembly lid 14 is depressed further downward, the tong portion 46 is elastically deformed outward, with the slanted surface 47*b* of the claw portion 47 being guided by the extended portion 81*a*, and finally, the perpendicular surface 47*a* of the claw portion 47 engages, with a snapping motion, with the downward facing surface of the extended portion 81*a* as illustrated in FIG. 19. As a result, the opening 14*b* of the apparatus main assembly, and the opening 3*b* of the toner holding portion 3*a* are completely closed by the apparatus main assembly lid 14. FIG. 19 depicts a state in which the refill toner container 8 has been properly mounted in the process cartridge 5, and the apparatus main assembly lid 14, and the toner holding portion lid 3*c* have been closed.

When the refill toner container 8 has not been mounted in the process cartridge 5, or when the wrong refill toner container 8 has been inserted in the process cartridge 5, the claw portion 47 cannot be engaged with the refill toner container 8. Therefore, users can be prevented from forgetting to mount the refill toner container 8, and also from mounting the wrong refill toner container 8.

Referring to FIG. 19, the toner holding portion lid 3*c* is closed with the end portion of the seal 12 projecting from the cutaway portion 3*d* of the toner holding portion 3*a*. Therefore, the opening 8*b* of the refill toner container 8 can be exposed by pulling outward the end portion of the seal 12 to release the toner T into the process cartridge 5.

EMBODIMENT 8

Figure 20:
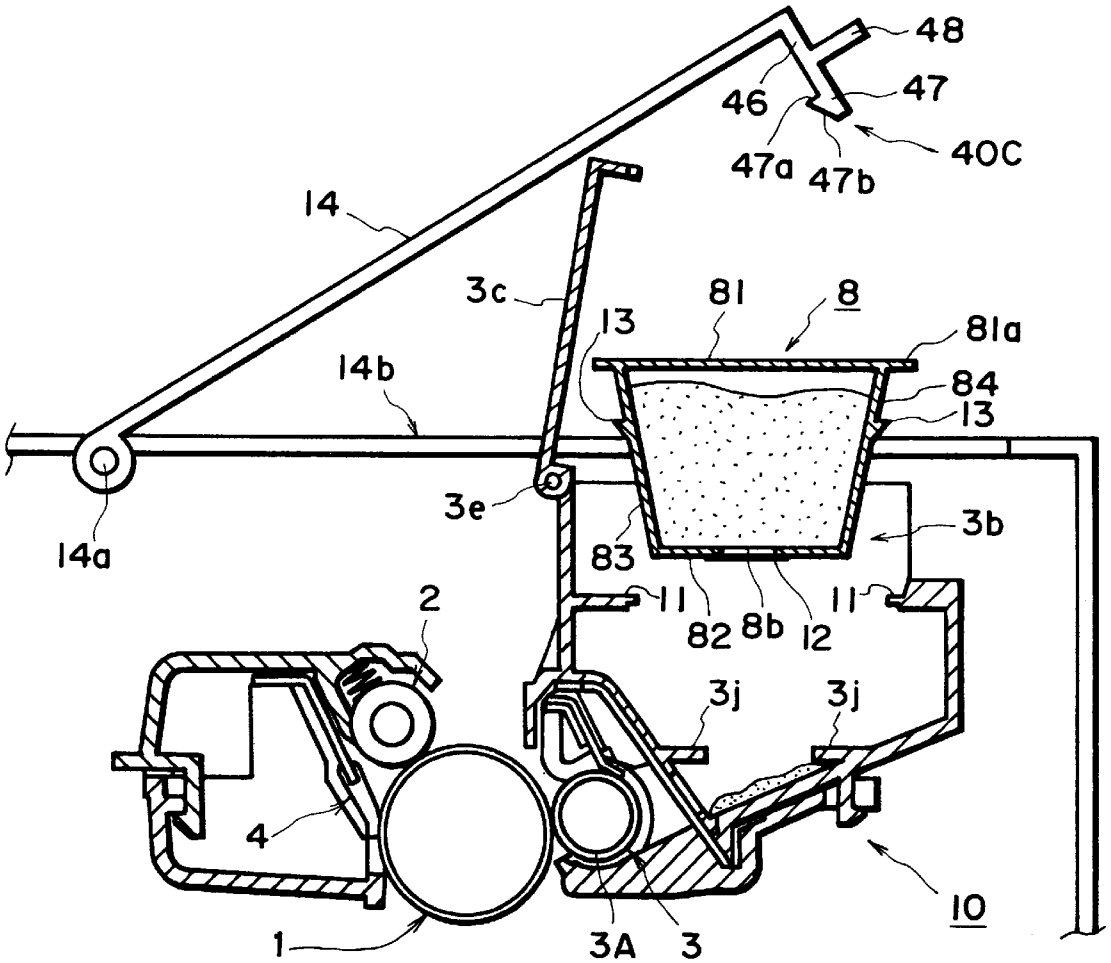
FIG. 20 is a sectional view of the developing device in another embodiment of the present invention.

FIG. 20 depicts the developing device cartridge 10 in accordance with another aspect of the present invention.

The developing device 10 of this embodiment is in the form of a cartridge, and integrally comprises a development sleeve 3A, a developing means 3 with a developer (toner) holding portion 3*a* which contains the toner T to be supplied to the development sleeve 3A, and a plastic frame 6. In other words, the developing device 10 is thought to be substantially the same as the process cartridge 5 described in the seventh embodiment, except that it lacks the photosensitive drum 1. Therefore, the structures and the functions of the toner holding portion 3*a*, the toner holding portion lid 3*c*, the refill toner container 8, the apparatus main assembly lid 14, the blocking member 40C, and the like components, are the same as the seventh embodiment, and the components having the same structures and functions are designated with the same reference numerals to substitute their descriptions with those given in the first embodiment. In FIG. 20, the apparatus main assembly lid 14, and the toner holding portion lid 3*c* of the developing device 10 are open, and the refill toner container 8 is being inserted into the developing device 10.

As described above, according to this embodiment, the refill toner container 8 is snugly fitted in the process cartridge or the toner holding portion of the developing device, and is not removed therefrom; therefore, when the refill toner container is mounted in the process cartridge or the developing device, it can be reliably fixed therein, without requiring a large space.

Further, the process cartridge, the developing device, or the image forming apparatus is provided with the blocking member, which prevents the lid of the developer holding portion or the lid of the apparatus main assembly from being normally closed unless a correct refill toner container is mounted in the process cartridge, or the toner holding portion of the developing device; therefore, users can be easily prevented from forgetting to mount the refill toner container, or from mounting the wrong refill toner container.

As described above, according to the present invention, it is possible to provide a refill toner container, a process cartridge, and an electro-photograpic image forming apparatus, which can prevent users from forgetting to mount the refill toner container.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container for supplying a developer for developing a latent image formed on a photosensitive member, wherein said developer supply container is mountable into a developer accommodating container, through an entrance opening, and the developer is supplied while said developer supply container is in said developer accommodating container, wherein the entrance opening is covered by an openable cover, wherein when said developer supply container is mounted and demounted, said openable cover is opened, and wherein said developer accommodating container is usable with an electrophotograpic image forming apparatus, said developer supply container comprising:

a developer accommodating portion for accommodating the developer;

a supply opening for supplying the developer accomodated in said developer accommodating portion to said developer accommodating container;

a seal member for openable sealing said supply opening; and a closing member for closing said openable cover, while said developer supply container is mounted in said developer accommodating container, wherein when said developer supply container is not mounted in said developer accommodating container, said openable cover is not closable.

2. A container according to claim 1, wherein a closure preventing member is provided in said developer accommodating container and includes a blocking portion for engaging with an openable cover engaging portion of said openable cover, wherein said blocking portion is movable between a position where said blocking portion is projected out of said developer accommmodating container and a position where said blocking portion is in said developer accommodating container, and has a container engaging portion which is contactable to said closing member when said developer supply container is mounted to said developer accommodating container, and wherein said openable cover is permitted to close by contact between said closing member and said second engaging portion when said developer supply container is mounted in said developer accommodating container.

3. A container according to claim 2, wherein said developer accommodating container is provided in a process cartridge usable with an electrophotograpic image forming apparatus, and said openable cover is provided in said process cartridge, and wherein said process cartridge contains an electrophotograpic photosensitive member and process means actable on the electrophotograpic photosensitive member, said process cartridge being detachably mountable to a main assembly of said electrophotograpic image forming apparatus, said process means including at least one of developing means, charging means and cleaning means.

4. A container according to claim 2, wherein said developer accommodating container is mounted to a main assembly of the electrophotograpic image forming apparatus, and said openable cover is provided in the developer accommodating container.

5. A container according to claim 2, wherein said developer accommodating container is provided in a process cartridge usable with an electrophotograpic image forming apparatus, and said openable cover is provided in a main assembly of said image forming apparatus, and wherein said process cartridge contains an electrophotograpic photosensitive member and process means actable on the electrophotograpic photosensitive member, said process cartridge being detachably mountable to the main assembly of said electrophotograpic image forming apparatus, said process means including at least one of developing means, charging means and cleaning means.

6. A container according to claim 1, wherein said closure preventing member includes a blocking portion for blocking closing of said openable cover, and a container engaging portion which is contacted to a part of said developer supply container in the process of said developer supply container being mounted into said developer accommodating container, and wherein in the process of mounting said developer supply container into said developer accommodating container, said container engaging portion is engaged with a part of said developer supply container to retract the blocking portion from a blocking position for blocking the closing of the openable cover to a retracted position, thus permitting closing of the openable cover.

7. A container according to claim 6, wherein said closure preventing member is provided in said process cartridge, and wherein said process cartridge contains an electrophotograpic photosensitive member and a process member actable on the electrophotograpic photosensitive member, said process cartridge being detachably mountable to a main assembly of said electrophotograpic image forming apparatus, said process member including at least one of a developing member, a charging member, and a cleaning member.

8. A container according to claim 6, wherein said developer accommodating container is provided in a main assembly of said electrophotograpic image forming apparatus, and wherein said closure preventing member is provided in the main assembly of said electrophotograpic image forming apparatus.

9. A container according to one of claims 1, 7, or 8, wherein said closure preventing member is rotatable between a blocking position where it is projected into a closing path of said openable cover, and a retracted position away from said blocking position.

10. A container according to claim 1, wherein said developer supply container is mounted into a space of said developer accommodating container created by consumption of the developer.

11. A developer supply container for supplying a developer for developing a latent image formed on an electrophotograpic photosensitive member, wherein said developer supply container is mountable into a developer accommodating container through an entrance opening, and the developer is supplied while said developer supply container is in said developer accommodating container, wherein the entrance opening is covered by an openable cover, wherein when said developer supply container is mounted and demounted, said openable cover is opened, said developer accommodating container is provided in said process cartridge, and wherein said process cartridge contains the electrophotograpic photosensitive member and process means actable on the electrophotograpic photosensitive member, said process cartridge being detachably mountable to a main assembly of said electrophotograpic image forming apparatus, and said process means including at least one of developing means, charging means and cleaning means, said developer supply container comprising:

a developer accommodating portion for accommodating the developer;

a supply opening for supplying the developer accommodated in said developer accommodating portion to said developer accommodating container;

a seal member for openably sealing said supply opening; and a closing member for engageably closing said openable cover, while said developer supply container is mounted in said developer accommodating container, wherein when said developer supply container is not mounted in said developer accommodating container, said openable cover is not closable.

12. A container according to claim 11, wherein said closing member includes an engaging portion for engaging with an engaging portion of said openable cover, and wherein the engaging portion of said openable cover and the engaging portion of the developer accommodating container are engaged with each other when the openable cover is closed.

13. A container according to claim 12, wherein said openable cover is provided in said process cartridge.

14. A container according to claim 12, wherein said openable cover is provided in a main assembly of said electrophotograpic image forming apparatus.

15. A container according to claim 11 or 14, wherein said developer supply container is locked in said developer accommodating container.

16. A container according to claim 11, wherein said developer supply container is mounted into a space of said developer accommodating container created by consumption of the developer.

17. A process cartridge detachably mountable to a main assembly of an image forming apparatus, wherein said process cartridge is provided with a developer accommodating container which can be supplied with a developer by a developer supply container, said process cartridge comprising:

an electrophotograpic photosensitive member;

a process member actable on said electrophotograpic photosensitive member;

a developer accommodating container for accommodating developer for developing a latent image formed on the electrophotograpic photosensitive member;

an entrance opening for permitting said developer supply container to enter said developer accommodating container;

an openable cover for openably closing said entrance opening;

a locking member, provided in said developer accommodating container, for locking said developer supply container in place; and a blocking member movable between a blocking position for blocking closing of said openable cover and a retracted position for permitting closing of said openable cover, wherein said blocking member is disposed in a movement path of said developer supply container from said entrance opening to said locking member, wherein when said developer supply container is in engagement with said locking member, an engaging member of said developer supply container is engaged with said blocking member to retract said blocking member to the retracted position, thus permitting closing of said openable cover.

18. A process cartridge according to claim 17, wherein said blocking member has a first operable segment for preventing said openable cover from closing said entrance opening and a second operable segment integral with said first operable segment and engageable with said engaging member, and a rotational axis about which said blocking member is rotatable, and wherein said blocking member is urged normally to the blocking position by an elastic force provided by a spring.

19. A process cartridge according to claim 17, wherein when said blocking member is at said blocking position, said first operable segment is projected upwardly beyond a top edge of said entrance opening, and said second operable segment is projected into the movement path of said developer supply container from said entrance opening to said locking member, wherein when said developer supply container is moved to be locked with said locking member, said developer supply container acts on said second operable segment to rotate said first operable segment about the rotational axis downwardly, and wherein said first operable segment is disposed inwardly of said entrance opening.

20. A process cartridge according to claim 17, wherein said locking member is elastically deformable, and said locking member is provided on an internal wall of said developer accommodating container, and is engageable with a locking portion provided on an external wall of said developer supply container.

21. A process cartridge according to claim 20, wherein after said locking member and said locking portion are locked with each other, disengagement therebetween is not permitted so that said developer supply container is not removable from said developer accommodating container.

22. A process cartridge according to claim 17, wherein said process member includes at least one of a charging member, a developing member, or a cleaning member.

23. A process cartridge according to claim 17, wherein said process member includes at least one of a charging member, a developing member, and a cleaning member.

24. A process cartridge according to claim 17, wherein said process member includes a developing member.

25. An electrophotograpic image forming apparatus for forming an image on a recording medium, to which a process cartridge is detachably mountable, wherein said process cartridge has a developer accommodating container which can be supplied with a developer by a developer supply container, said apparatus comprising:

a mounting portion for mounting said process cartridge, said process cartridge including:

an electrophotograpic photosensitive member;

a process member actable on said electrophotograpic photosensitive member;

a developer accommodating container for accommodating developer for developing a latent image formed on the electrophotograpic photosensitive member;

an entrance opening for permitting said developer supply container to enter said developer accommodating container;

an openable cover for openably closing said entrance opening;

a locking member, provided in said developer accommodating container, for locking said developer supply container in place; and a blocking member movable between a blocking position for blocking closing of said openable cover and a retracted position for permitting closing of said openable cover, wherein said blocking member is disposed in a movement path of said developer supply container from said entrance opening to said locking member;

wherein when said developer supply container is in engagement with said locking member, an engaging member of said developer supply container is engaged with said blocking member to retracet said blocking member to the retracted position, thus permitting closing of said openable cover; and a feeding member for feeding the recording medium.

26. An apparatus according to claim 25, wherein said blocking member has a first operable segment for preventing said cover from closing said entrance opening and a second operable segment integral with said first operable segment and engageable with said engaging member, and a rotational axis about which said blocking member is rotatable, and wherein said blocking member is urged normally to the blocking position by an elastic force provided by a spring.

27. An apparatus according to claim 26, wherein when said blocking member is at said blocking position, said first operable segment is projected upwardly beyond a top edge of said entrance opening, and said second operable segment is projected into the movement path of said developer supply container from said entrance opening to said locking member, wherein when said developer supply container is moved to be locked with said locking member, said developer supply container acts on said second operable segment to rotate said first operable segment about the rotational axis downwardly, and wherein said first operable segment is disposed inside of said entrance opening.

28. An apparatus according to claim 25, wherein said locking member is elastically deformable, and said locking member is provided on an internal wall of said developer accommodating container, and is engageable with a locking portion provided on an external wall of said developer supply container.

29. An apparatus according to claim 28, wherein after said locking member and said locking portion are locked with each other, disengagement therebetween is not permitted so that said developer supply container is not removable from said developer accommodating container.

30. An apparatus according to claim 25, wherein said process member includes a charging member, a developing member, or a cleaning member.

31. An apparatus according to claim 25, wherein said process member includes at least one of a charging member, a developing member, and a cleaning member.

32. An apparatus according to claim 25, wherein said process member includes a developing member.

33. A process cartridge detachably mountable to a main assembly of an image forming apparatus, wherein said process cartridge is provided with a developer accommodating container which can be supplied with a developer by a developer supply container, said process cartridge comprising:

an electrophotograpic photosensitive member;

a process member actable on said electrophotograpic photosensitive member;

a developer accommodating container for accommodating developer for developing a latent image formed on the electrophotograpic photosensitive member;

an entrance opening for permitting said developer supply container to enter said developer accommodating container;

an openable cover for openably closing said entrance opening, wherein said openable cover is engageable with an engaging member of said developer supply container; and a locking member, provided in said developer accommodating container, for locking said developer supply container in place, wherein when said developer supply container is in engagement with said locking member, said openable cover is engaged with said engaging member to permit closing of said openable cover.

34. A process cartridge according to claim 33, wherein said openable cover is rotatable about a shaft provided at an end thereof, and wherein a claw member provided at another end of said openable cover is engaged with an extension of a top wall of said developer supply container as said engaging member of said developer supply container.

35. A process cartridge according to claim 33, wherein said locking member is elastically deformable, and said locking member is provided on an internal wall of said developer accommodating container, and is engageable with a locking portion provided on an external wall of said developer supply container.

36. A process cartridge according to claim 35, wherein after said locking member and said locking portion are locked with each other, disengagement therebetween is not permitted so that said developer supply container is not removable from said developer accommodating container.

37. A process cartridge according to claim 33, wherein said process member includes a charging member, a developing member, or a cleaning member.

38. A process cartridge according to claim 33, wherein said process member includes at least one of a charging member, a developing member, and a cleaning member.

39. A process cartridge according to claim 33, wherein said process member includes a developing member.

40. An electrophotograpic image forming apparatus for forming an image on a recording medium, to which a process cartridge is detachably mountable, wherein said process cartridge has a developer accommodating container which can be supplied with a developer by a developer supply container, said apparatus comprising:

a main-assembly openable cover provided in a main assembly of said apparatus, wherein when said cover is opened, said process cartridge is permitted to be mounted to a mounting portion of said apparatus, said process cartridge including:

an electrophotograpic photosensitive member;

a process member actable on said electrophotograpic photosensitive member;

a developer accommodating container for accommodating developer for developing a latent image formed on the electrophotograpic photosensitive member;

an entrance opening for permitting said developer supply container to enter said developer accommodating container;

a cartridge openable cover for openably closing said entrance opening, wherein said cartridge openable cover is engageable with an engaging member of said developer supply container; and a locking member, provided in said developer accommodating container, for locking said developer supply container in place, wherein when said developer supply container is in engagement with said locking member, said cartridge openable cover is engaged with said engaging member to permit closing of said main assembly openable cover; and a feeding member for feeding the recording medium.

41. An apparatus according to claim 40, wherein said cartridge openable cover is rotatable about a shaft provided at an end thereof, and wherein a claw member provided at another end of said cartridge openable cover is engaged with an extension of a top wall of said developer supply container as said engaging member of said developer supply container.

42. An apparatus according to claim 40, wherein said locking member is elastically deformable, and said locking member is provided on an internal wall of said developer accommodating container, and is engageable with a locking portion provided on an external wall of said developer supply container.

43. An apparatus according to claim 42, wherein after said locking member and said locking portion are locked with each other, disengagement therebetween is not permitted so that said developer supply container is not removable from said developer accommodating container.

44. An apparatus according to claim 40, wherein said process member includes a charging member, a developing member, or a cleaning member.

45. An apparatus according to claim 40, wherein said process member includes at least one of a charging member, a developing member, and a cleaning member.

46. An apparatus according to claim 40, wherein said process member includes a developing member.

47. A process cartridge detachably mountable to a main assembly of an image forming apparatus, wherein said process cartridge is provided with a developer accommodating container which can be supplied with a developer by a developer supply container, the developer accommodating container thereby accommodating developer for developing a latent image formed on an electrophotograpic photosensitive member, said process cartridge comprising:

the electrophotograpic photosensitive member;

process member actable on said electrophotograpic photosensitive member;

an entrance opening for permitting the developer supply container to enter said developer accommodating container;

an openable cover for openably closing said entrance opening; and a blocking member movable between a blocking position for blocking closing of said openable cover and a retracted position for permitting closing of said openable cover, wherein said blocking member is disposed in a movement path of the developer supply container from said entrance opening into said developer accommodating container, wherein, when the developer supply container is mounted at a predetermined position in said developer accommodating container, an engaging portion of the developer supply container is engaged with said blocking member to retract said blocking member to the retracted position, thus permitting closing of said openable cover.

48. A process cartridge according to claim 47, wherein said blocking member has a first operable segment for preventing said openable cover from closing said entrance opening, a second operable segment integral with said first operable segment and engageable with the engaging portion, and a rotational axis about which said blocking member is rotatable, and wherein said blocking member is urged normally to the blocking position by an elastic force provided by a spring.

49. A process cartridge according to claim 48, wherein, when said blocking member is at the blocking position, said first operable segment is projected upwardly beyond a top edge of said entrance opening, and said second operable segment is projected into the movement path of the developer supply container from said entrance opening into said developer accommodating container, wherein, when the developer supply container is moved into said developer accommodating container, the developer supply container acts on said second operable segment to rotate said first operable segment about the rotational axis downwardly, and wherein said first operable segment is inside said entrance opening.

50. A process cartridge according to claim 47, wherein said process member includes a charging member, a developing member, or a cleaning member.

51. A process cartridge according to claim 47, wherein said process member includes at least one of a charging member, a developing member, and a cleaning member.

52. A process cartridge according to claim 47, wherein said process member includes a developing member.

53. A process cartridge detachably mountable to a main assembly of an image forming apparatus, wherein said process cartridge is provided with a developer accommodating container which can be supplied with a developer by a developer supply container, said process cartridge comprising:

an electrophotograpic photosensitive member;

a process member actable on said electrophotograpic photosensitive member;

a developer accommodating container for accommodating developer for developing a latent image formed on said electrophotograpic photosensitive member;

an entrance opening for permitting the developer supply container to enter said developer accommodating container; and an openable cover for openably closing said entrance opening, wherein said openable cover is engageable with an engaging portion of the developer supply container, wherein, when the developer supply container is mounted at a predetermined position in said developer accommodating container, said openable cover is engaged with the engaging portion to permit closing of said openable cover.

54. A process cartridge according to claim 53, wherein said openable cover is rotatable about a shaft provided at an end thereof, and wherein a claw member provided at another end of said openable cover is engaged with an extension of a top wall of the developer supply container as the engaging portion of the developer supply container.

55. A process cartridge according to claim 53, wherein said process member includes a charging member, a developing member, or a cleaning member.

56. A process cartridge according to claim 53, wherein said process member includes at least one of a charging member, a developing member, and a cleaning member.

57. A process cartridge according to claim 53, wherein said process member includes a developing member.

58. A process cartridge detachably mountable to a main assembly of an image forming apparatus, wherein said process cartridge is provided with a developer accommodating container which can be supplied with a developer by a developer supply container, said process cartridge comprising:

an electrophotograpic photosensitive member;

a process member actable on said electrophotograpic photosensitive member;

said developer accommodating container for accommodating developer for developing a latent image formed on said electrophotograpic photosensitive member;

an entrance opening for permitting the developer supply container to enter said developer accommodating container;

an openable cover for openably closing said entrance opening, wherein, when the developer supply container is mounted and demounted, said openable cover is opened; and a closure preventing member for preventing said openable cover from closing when the developer supply container is not mounted in said developer accommodating container, while permitting said openable cover to close when the developer supply container is mounted in said developer accommodating container.

59. A process cartridge according to claim 58, wherein said closure preventing member includes an engaging portion for engaging with an engaging portion of said openable cover, wherein said engaging portion of said closure preventing member is movable between a position where said engaging portion of said closure preventing member is projected out of said developer accommodating container, and a position where said engaging portion of said closure preventing member is in said developer accommodating container.

60. A process cartridge according to claim 58 or 59, wherein said closure preventing member includes a blocking portion for blocking closing of said openable cover, and a container engaging portion which is contacted to a part of the developer supply container in the process of the developer supply container being mounted into said developer accommodating container, and wherein in the process of mounting the developer supply container into said developer accommodating container, said container engaging portion is engaged with a part of the developer supply container to retract said blocking portion from a blocking position for blocking the closing of said openable cover to a retracted position, thus permitting closing of said openable cover.

61. A process cartridge according to claim 58 or 59, wherein said closure preventing member is rotatable between a blocking position, where said closure preventing member is projected into a closing path of said openable cover, and a retracted position away from said blocking position.

62. A process cartridge according to claim 61, wherein the developer supply container is mounted into a space of said developer accommodating container created by consumption of the developer.

63. A process cartridge according to claim 61, wherein said process member includes at least one of a developing member, a charging member, and a cleaning member.

* * * * *

UNITED STATES PATENT AND TRADEMARK OFFICE

CERTIFICATE OF CORRECTION

PATENT NO. : 6,115,571

DATED : September 5, 2000

INVENTOR(S): KAZUNORI KOBAYASHI

It is certified that error appears in the above-identified patent and that said Letters Patent is hereby corrected as shown below:

Column 14:
Line 43, "accomo-" should read –accommo- --.

Column 15:
Line 6, "electrophotograpic" should read –electrophotographic--.
Line 9, "electrophotograpic" should read –electrophotographic--.
Line 10, "electrophotograpic" should read –electrophotographic--.
Line 12, "electrophotograpic" should read –electrophotographic--.
Line 17, "electrophotograpic" should read –electrophotographic--.
Line 22, "electrophotograpic" should read –electrophotographic--.
Line 25, "electrophotograpic" should read –electrophotographic--.
Line 27, "tograpic" should read –tographic--.
Line 29, "electrophotograpic" should read –electrophotographic--.
Line 48, "tograpic" should read –tographic--.
Line 49, "electrophotograpic" should read –electrophotographic--.
Line 51, "electrophotograpic" should read –electrophotographic--.
Line 57, "electrophotograpic" should read –electrophotographic--.
Line 59, "electrophotograpic" should read –electrophotographic--.

UNITED STATES PATENT AND TRADEMARK OFFICE

CERTIFICATE OF CORRECTION

PATENT NO. : 6,115,571

DATED : September 5, 2000

INVENTOR(S): KAZUNORI KOBAYASHI

It is certified that error appears in the above-identified patent and that said Letters Patent is hereby corrected as shown below:

Column 16:
Line 5, "photograpic" should read –photographic--.
Line 14, "electrophotograpic" should read –electrophotographic--.
Line 15, "electrophotograpic" should read –electrophotographic--.
Line 17, "electrophotograpic" should read –electrophotographic--.
Line 44, "electrophotograpic" should read –electrophotographic--.
Line 45, "14," should read –13,--.
Line 58, "electrophotograpic" should read –electrophotographic--.
Line 59, 'electrophotograpic" should read –electrophotographic--.
Line 63, "electrophotograpic" should read –electrophotographic--.

Column 17:
Line 26, "claim 17," should read –claim 18,--.
Line 57, "electrophotograpic" should read –electrophotographic--.
Line 65, "electrophotograpic" should read –electrophotographic--.
Line 66, "electrophotograpic" should read –electrophotographic--.

Column 18:
Line 3, "electrophotograpic" should read –electrophotographic--.

UNITED STATES PATENT AND TRADEMARK OFFICE

CERTIFICATE OF CORRECTION

PATENT NO. : 6,115,571

DATED : September 5, 2000

INVENTOR(S): KAZUNORI KOBAYASHI

It is certified that error appears in the above-identified patent and that said Letters Patent is hereby corrected as shown below:

Column 19:
Line 4, "electrophotograpic" should read –electrophotographic--.
Line 5, "electrophotograpic" should read –electrophotographic--.
Line 9, "electrophotograpic" should read –electrophotographic--.
Line 50, "electrophotograpic" should read –electrophotographic--
Line 61, "electrophotograpic" should read –electrophotographic--.
Line 62, "electrophotograpic" should read –electrophotographic--.
Line 66, "electrophotograpic" should read –electrophotographic--.

Column 20:
Line 48, "electrophotograpic" should read –electrophotographic--.
Line 50, "electrophotograpic" should read –electrophotographic--.
Line 51, "process" should read –a process--, and "electrophotograpic" should read –electrophotographic--.

Column 21:
Line 40, "electrophotograpic" should read –electrophotographic--.
Line 41, "electrophotograpic" should read –electrophotographic--.
Line 45, "electrophotograpic" should read –electrophotographic--.

UNITED STATES PATENT AND TRADEMARK OFFICE

CERTIFICATE OF CORRECTION

PATENT NO. : 6,115,571

DATED : September 5, 2000

INVENTOR(S): KAZUNORI KOBAYASHI

It is certified that error appears in the above-identified patent and that said Letters Patent is hereby corrected as shown below:

Column 22:

Line 12, "electrophotograpic" should read –electrophotographic--.

Line 13, "electrophotograpic" should read –electrophotographic--.

Line 17, "electrophotograpic" should read –electrophotographic--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*